US009651916B2

(12) United States Patent
Kawakami et al.

(10) Patent No.: US 9,651,916 B2
(45) Date of Patent: May 16, 2017

(54) CARTRIDGE HAVING STORING MEDIUM AND IMAGE FORMING APPARATUS USING THE CARTRIDGE

(71) Applicant: CANON KABUSHIKI KAISHA, Tokyo (JP)

(72) Inventors: Takuya Kawakami, Mishima (JP); Naoya Asanuma, Susono (JP); Takayuki Yada, Suntou-gun (JP); Kiyoshi Furuta, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/940,321

(22) Filed: Nov. 13, 2015

(65) Prior Publication Data

US 2016/0139558 A1 May 19, 2016

(30) Foreign Application Priority Data

Nov. 19, 2014 (JP) ..... 2014-234154

(51) Int. Cl.
*G03G 21/00* (2006.01)
*G03G 21/18* (2006.01)

(52) U.S. Cl.
CPC ..... *G03G 21/1867* (2013.01); *G03G 21/1871* (2013.01); *G03G 21/1885* (2013.01); *G03G 2221/1823* (2013.01)

(58) Field of Classification Search
CPC ..... G03G 21/1868; G03G 21/1871; G03G 21/1867; G03G 15/80; G03G 21/1885;
(Continued)

(56) References Cited

U.S. PATENT DOCUMENTS 6,097,906 A * 8/2000 Matsuzaki ..... G03G 21/1885 399/111
6,898,392 B2 * 5/2005 Karakama ..... G03G 21/1853 399/111
(Continued)

FOREIGN PATENT DOCUMENTS

JP 2005345587 A 12/2005
JP 2007047397 A 2/2007
(Continued)

OTHER PUBLICATIONS

Extended Search Report issued in European Appln. No. 15193120.1 mailed Apr. 4, 2016.

*Primary Examiner* — Robert Beatty
(74) *Attorney, Agent, or Firm* — Rossi, Kimms & McDowell LLP

(57) ABSTRACT

A cartridge insertable into a main assembly of an image forming apparatus includes a first unit including a first bearing portion for supporting an image bearing member, a second unit including a second bearing portion for supporting a developer carrying member, and a storing medium including an electrical contact. The second bearing portion is provided inside the first bearing portion with respect to a rotational axis direction of the image bearing member. At least a part of the storing medium is supported by the second unit and is provided at a position outside the second bearing portion and inside an outermost configuration of the first unit with respect to the rotational axis direction. The electrical contact is faced toward a downstream with respect to an inserting direction of the cartridge into the main assembly.

36 Claims, 20 Drawing Sheets

(58) Field of Classification Search
CPC ..... G03G 21/1652; G03G 21/1821; G03G 21/1633; G03G 21/1853; G03G 21/1842; G03G 2221/1684; G03G 2221/1869; G03G 2221/1853; G03G 2221/1823; G03G 2221/166
USPC ..... 399/90, 113
See application file for complete search history.

(56) References Cited

U.S. PATENT DOCUMENTS

| | | | | |
|---|---|---|---|---|
| 7,184,682 | B2 * | 2/2007 | Chadani | G03G 21/1825 399/111 |
| 9,291,994 | B2 * | 3/2016 | Kanno | G03G 21/1878 |
| 2005/0047821 | A1 | 3/2005 | Murayama et al. | |
| 2011/0129252 | A1 * | 6/2011 | Oda | G03G 21/1821 399/119 |
| 2012/0039622 | A1 | 2/2012 | Cho | |
| 2014/0086597 | A1 * | 3/2014 | Tanabe | G03G 21/1867 399/12 |
| 2014/0169824 | A1 | 6/2014 | Seto et al. | |

FOREIGN PATENT DOCUMENTS

| | | | |
|---|---|---|---|
| JP | 2007047399 | A | 2/2007 |
| JP | 2008224782 | A | 9/2008 |

* cited by examiner

CARTRIDGE HAVING STORING MEDIUM AND IMAGE FORMING APPARATUS USING THE CARTRIDGE

FIELD OF THE INVENTION AND RELATED ART

The present invention relates to a cartridge and an image forming apparatus using the cartridge, and the cartridge is suitably used for an electrophotographic copying machine, an electrophotographic printer (LED printer, laser beam printer or the like), a facsimile apparatus, a word processor, and so on.

In the image forming apparatus, an electrophotographic photosensitive member generally of a drum type as an image bearing member, i.e., a photosensitive drum is electrically charged uniformly. Then, the charged photosensitive drum is subjected to selective exposure to light, whereby an electrostatic latent image (electrostatic image) is formed. Then, the electrostatic latent image formed on the photosensitive drum is developed into a toner image with toner as developer. Thereafter, the toner image is transferred from the photosensitive drum onto a recording material such as a recording sheet or a plastic sheet, and then heat and pressure are applied to the toner image transferred on the recording material, so that the toner image is fixed on the recording material and thus image recording is effected.

Such an image forming apparatus requires toner supply and maintenance of various process means in general. In order to facilitate the toner supply and the maintenance, a process cartridge type in which the photosensitive drum, a charging means, a developing means, a cleaning means and the like are integrally assembled into a cartridge (unit) in a frame and the cartridge is used as a process cartridge detachably mountable to an image forming apparatus main assembly has been put into practical use.

Here, the process cartridge is such a cartridge that an image bearing member such as an electrophotographic photosensitive drum is at least provided and that the image bearing member and process means actable on the image bearing member are integrally provided. Such a process cartridge is detachably mounted in the image forming apparatus main assembly.

According to this process cartridge type, the maintenance of the image forming apparatus can be made by a user himself (herself), and therefore operativity can be remarkably improved, so that it is possible to provide an image forming apparatus excellent in usability. For that reason, the process cartridge type has been widely used in the image forming apparatus.

On the above-described process cartridge, a storing medium for storing various pieces of service information and process information is mounted in some cases. The image forming apparatus uses these pieces of the information, so that an image quality and a maintenance property are further improved.

In order to establish a stable electrical connection between the storing medium and the image forming apparatus main assembly, an image forming apparatus in which the storing medium and the image forming apparatus main assembly are positioned relative to each other has been known (Japanese Laid-Open Patent Applications 2007-47397, 2008-224782 and 2007-47399).

For the purpose of establishing the stable electrical connection between the storing medium and the image forming apparatus main assembly, it is desired that the positioning between the storing medium and the image forming apparatus main assembly relative to each other can be effected without providing a particular space.

SUMMARY OF THE INVENTION

A principal object of the present invention is to provide a cartridge capable of effecting positioning between a storing medium and an image forming apparatus main assembly relative to each other without providing a particular space in order to establish a stable electrical connection between the storing medium and the image forming apparatus main assembly.

Another object of the present invention is to provide an image forming apparatus using the cartridge.

According to an aspect of the present invention, there is provided a cartridge insertable into a main assembly of an image forming apparatus, comprising: a first unit including a first bearing portion for supporting an image bearing member; a second unit including a second bearing portion for supporting a developer carrying member; and a storing medium including an electrical contact, wherein the second bearing portion is provided inside the first bearing portion with respect to a rotational axis direction of the image bearing member, wherein at least a part of the storing medium is supported by the second unit and is provided at a position outside the second bearing portion and inside an outermost configuration of the first unit with respect to the rotational axis direction, and wherein the electrical contact is faced toward a downstream with respect to an inserting direction into the main assembly.

According to another aspect of the present invention, there is provided a cartridge insertable into a main assembly of an image forming apparatus, comprising: a first unit including a first bearing portion for supporting an image bearing member; a second unit including a second bearing portion for supporting a developer carrying member; and a storing medium including an electrical contact, wherein the first bearing portion is provided inside the second bearing portion with respect to a rotational axis direction of the image bearing member, wherein at least a part of the storing medium is supported by the first unit and is provided at a position outside the first bearing portion and inside an outermost configuration of the second unit with respect to the rotational axis direction, and wherein the electrical contact is faced toward a downstream with respect to an inserting direction into the main assembly.

According to another aspect of the present invention, there is provided a cartridge insertable into a main assembly of an image forming apparatus, comprising: a developing unit including a developing bearing portion for supporting a developer carrying member; and a storing medium including an electrical contact, wherein the developing bearing portion is provided inside an image bearing member bearing portion with respect to a rotational axis direction of the developer carrying member, wherein at least a part of the storing medium is supported by the developing unit and is provided at a position outside the developing bearing portion and inside an outermost configuration of an image bearing member unit including the image bearing member bearing portion with respect to the rotational axis direction, and wherein the electrical contact is faced toward a downstream with respect to an inserting direction into the main assembly.

According to another aspect of the present invention, there is provided a cartridge insertable into a main assembly of an image forming apparatus, comprising: an image bearing member unit including an image bearing member bearing portion for supporting an image bearing member; and a storing medium including an electrical contact, wherein the image bearing member bearing portion is provided inside a developing bearing portion with respect to a rotational axis direction of the image bearing member, wherein at least a part of the storing medium is supported by the image bearing member unit and is provided at a position outside the image bearing member bearing portion and inside an outermost configuration of a developer carrying member unit including the developing bearing portion with respect to the rotational axis direction, and wherein the electrical contact is faced toward a downstream with respect to an inserting direction into the main assembly.

According to another aspect of the present invention, there is provided an image forming apparatus comprising the above-described cartridge and a tray for moving the cartridge, wherein the tray is movable between an inner position of the main assembly and an outer position of the main assembly.

According to a further aspect of the present invention, there is provided an image forming apparatus, comprising: a cartridge insertable into a main assembly of an image forming apparatus, including a first unit including a first bearing portion for supporting an image bearing member, a second unit including a second bearing portion for supporting a developer carrying member, and a storing medium including an electrical contact; and a tray for mounting the cartridge, wherein the tray is movable between an inner position of the main assembly and an outer position of the main assembly, wherein the electrical contact is faced toward a downstream with respect to an inserting direction into the main assembly.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described in detail with reference to the drawings.

First Embodiment

First Embodiment will be described.

In the following description, a rotational axis direction of a photosensitive drum 62 as an image bearing member is a longitudinal direction. Further, with respect to the longitudinal direction, a side in which the drum 62 receives a driving force from an image forming apparatus main assembly A is a driving side, and an opposite side thereof is a non-driving side. A general structure and an image forming process will be described using FIGS. 2 and 3.

Figure 2:
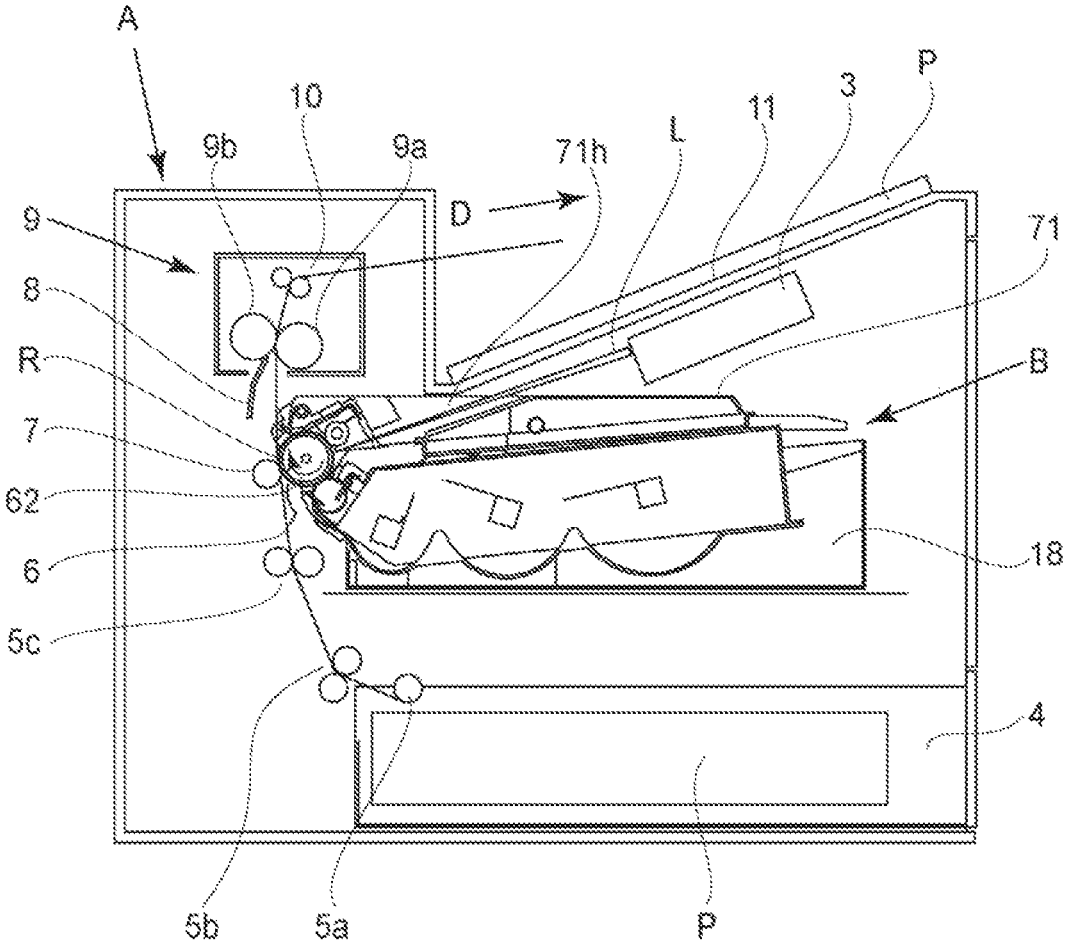
FIG. 2 is a sectional view of a main assembly of an image forming apparatus and the process cartridge in First Embodiment.

FIG. 2 is a sectional view of the apparatus main assembly A and a process cartridge B in this embodiment. The apparatus main assembly A is a portion from which the cartridge B is removed.

(General Structure of Image Forming Apparatus)

The image forming apparatus shown in FIG. 2 is a laser beam printer in which the cartridge B is detachably mountable to the apparatus main assembly A and which uses electrophotographic technology. When the cartridge B is mounted in the apparatus main assembly A, an exposure device (laser scanner unit) 3 for forming a latent image on the drum 62 is provided. Further, below the cartridge B, a sheet (feeding) tray 4 in which a recording material (sheet material) P to be subjected to image formation is accommodated is provided.

Further, in the apparatus main assembly A, along a feeding direction D of the sheet material P, a pick-up roller 5*a*, a feeding roller pair 5*b*, a conveying roller pair 5*c*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

(Image Forming Process)

An outline of an image forming process will be described. On the basis of a print start signal, the drum 62 is rotationally driven at a predetermined peripheral speed (process speed) in an arrow R direction. Further, a charging roller 66 to which a bias voltage is applied contacts an outer peripheral surface of the drum 62 and electrically charges the outer peripheral surface of the drum 62 uniformly.

The exposure device 3 outputs laser light L depending on image information. The laser light L passes through a laser opening 71*h* provided in a cleaning frame 71, so that the outer peripheral surface of the drum 62 is subjected to scanning exposure. As a result, on the outer peripheral surface of the drum 62, an electrostatic latent image depending on the image information is formed.

On the other hand, in a developing unit 20 (second unit) as a developing device, a toner T in a toner chamber 29 is stirred and fed by rotation of a first feeding member 43, a second feeding member 44 and a third feeding member 50, thus being sent to a toner supplying chamber 28. The toner T is carried by a magnetic force of a magnet roller 34 (fixed magnet) on a surface of a developing roller 32 as a developer carrying member.

The toner T is regulated in layer thickness on the peripheral surface of the developing roller 32 by a developing blade 42 while being triboelectrically charged. The toner T is supplied onto the drum 62 depending on the electrostatic latent image, so that the electrostatic latent image is visualized (developed) as a toner image.

As shown in FIG. 2, in synchronism with output timing of the laser light L by the pick-up roller 5*a*, the feeding roller pair 5*b* and the conveying roller pair 5*c*, the sheet material P accommodated in the sheet tray 4 provided at a lower portion of the apparatus main assembly A is fed. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a nip between the heating roller 9*a* and the pressing roller 9*b* which constitute the fixing device 9. At this nip, a pressure and heat-fixing process is effected, so that the toner image is fixed on the sheet material P. The sheet material P on which the toner image is fixed is fed to the discharging roller pair 10 and then is discharged onto the discharge tray 11.

Figure 3:
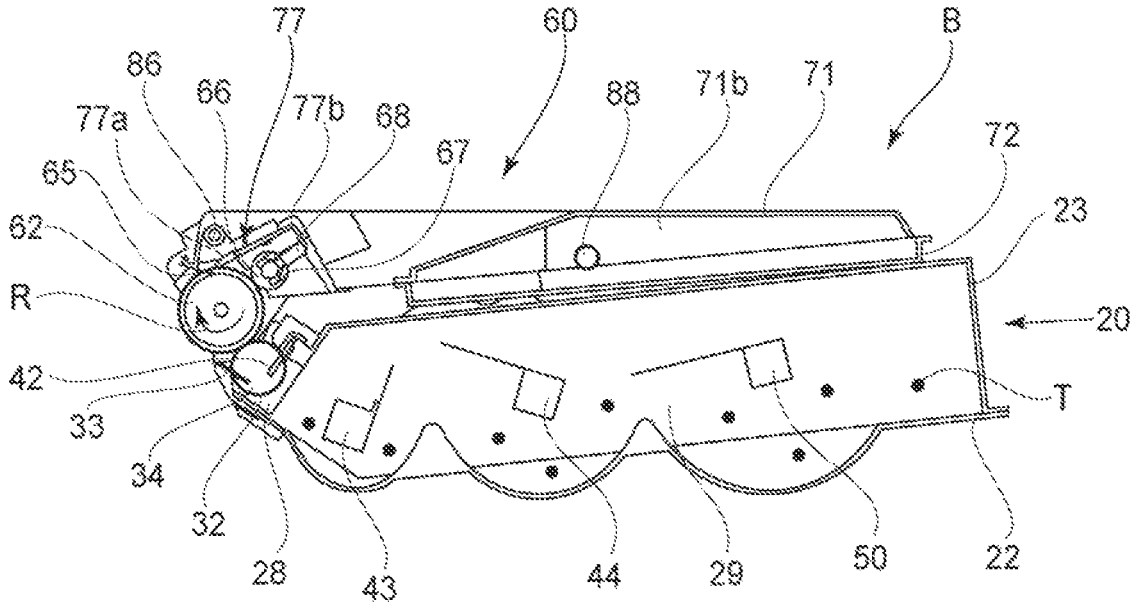
FIG. 3 is a sectional view of the process cartridge in First Embodiment.
Figure 4:
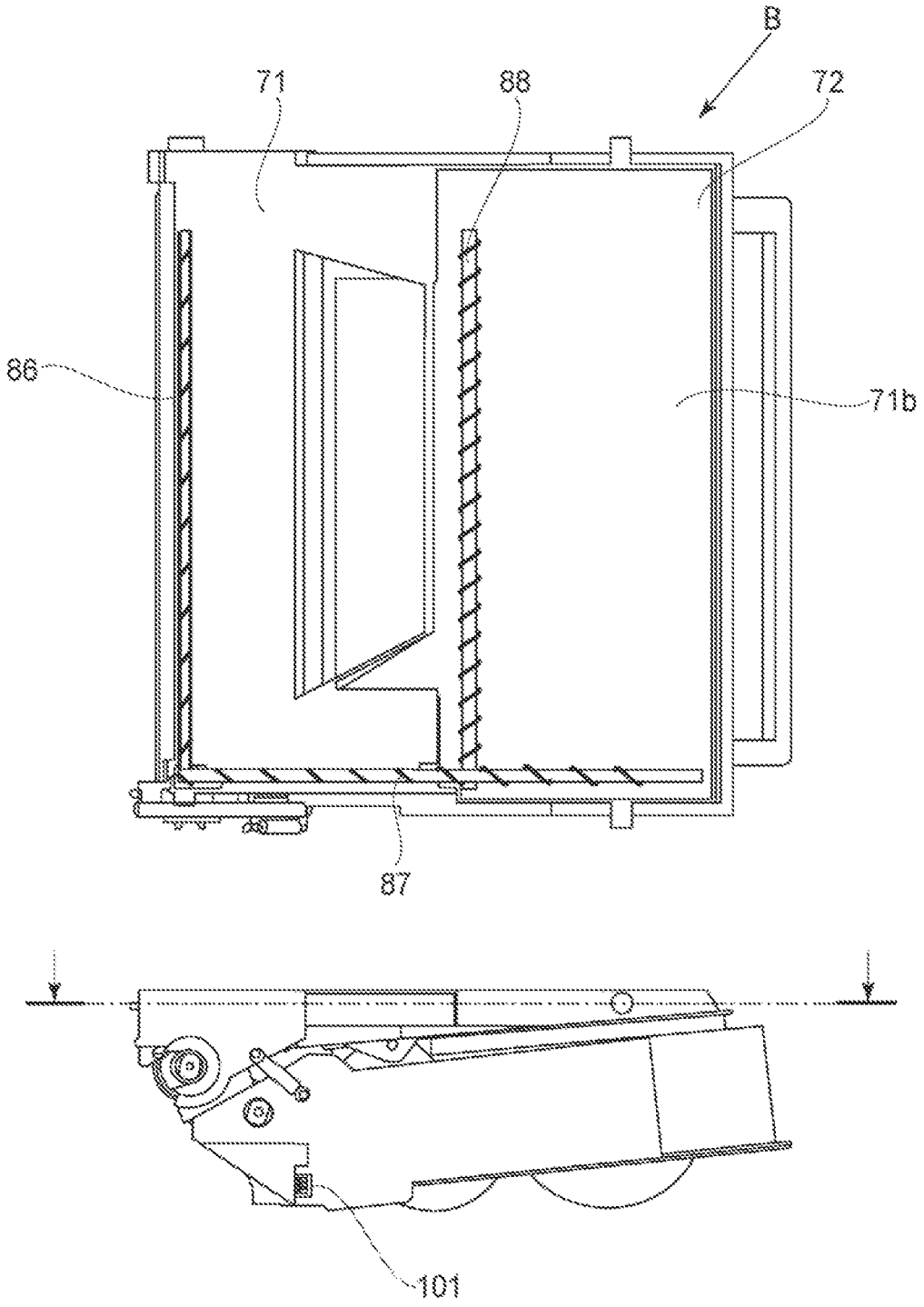
FIG. 4 is a sectional view showing an inside of a cleaning container of the process cartridge in First Embodiment.

On the other hand, as shown in FIG. 3, the drum 62 after the toner image transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60 as a first unit.

In the above, the charging roller 66, the developing roller 32, the transfer blade 7 and the cleaning blade 77 are process means actable on the drum 62.

(Mounting and Demounting of Cartridge)

Figure 5:
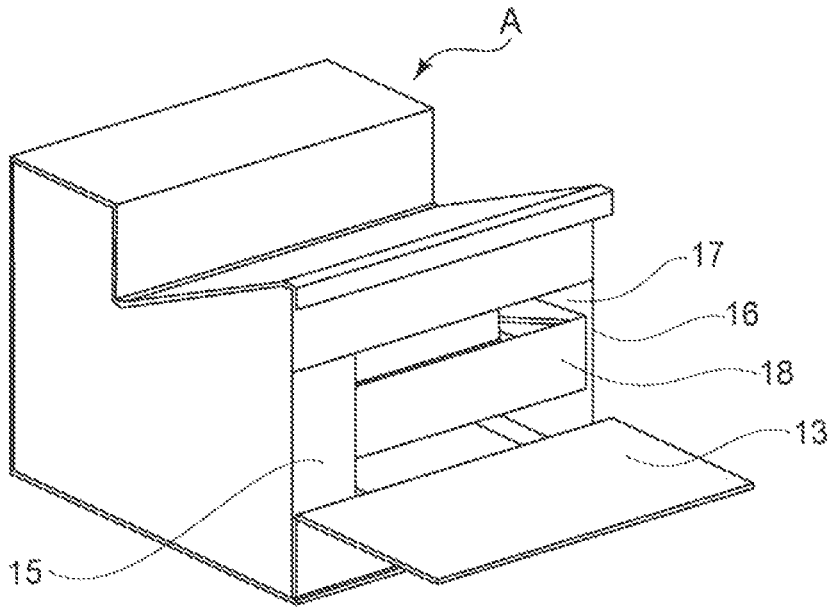
FIG. 5 is a perspective view of the image forming apparatus main assembly in a state in which an openable door of the image forming apparatus in First Embodiment is open.
Figure 6:
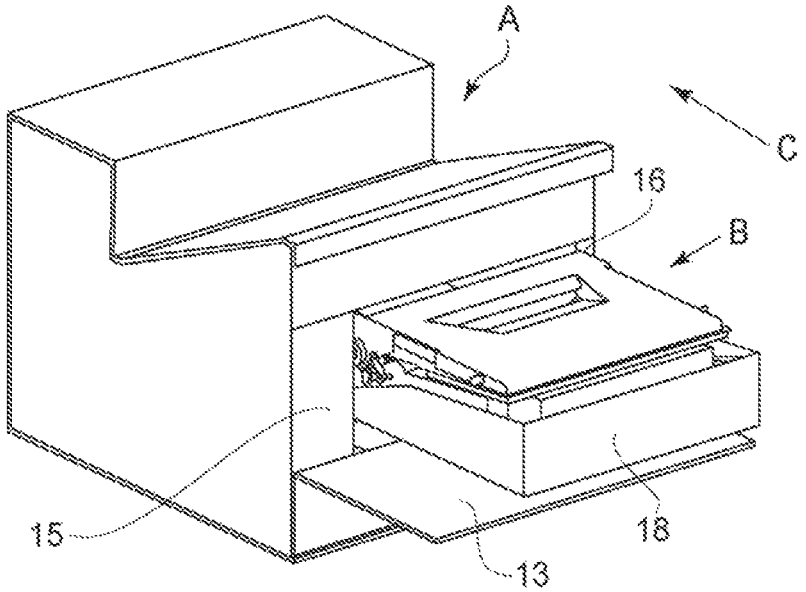
FIG. 6 is a perspective view of the image forming apparatus main assembly in a state in which the openable door of the image forming apparatus in First Embodiment is opened and then a tray is pulled out.
Figure 7:
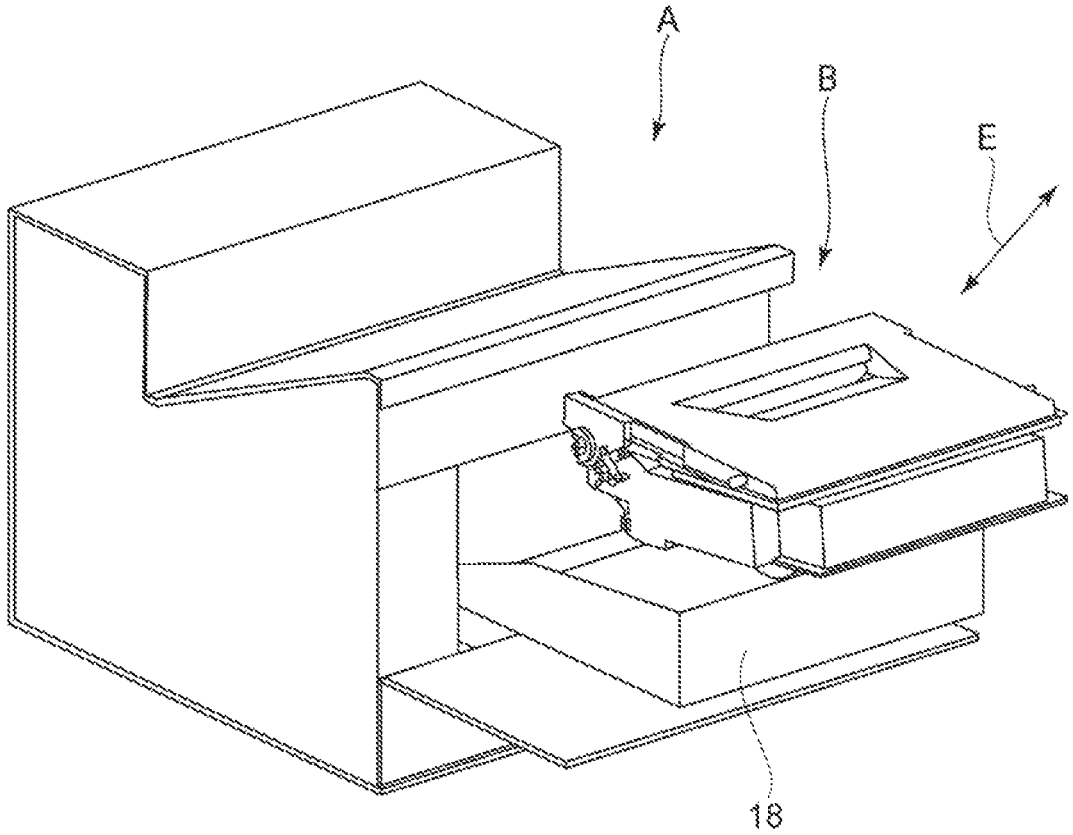
FIG. 7 is a perspective view of the image forming apparatus main assembly and the process cartridge when the process cartridge is mounted in and demounted from the tray in the state in which the openable door of the image forming apparatus in First Embodiment is opened and then the tray is pulled out.

Next, mounting and demounting of the cartridge B will be described using FIGS. 5 and 6. FIG. 5 is a perspective view of the apparatus main assembly A for which an openable door 13 is opened for permitting mount and demounting of the cartridge B. FIG. 6 is a perspective view of the apparatus main assembly A and the cartridge B in a state in which the openable door 13 is opened for permitting the mounting and demounting of the cartridge B and then a tray 18 is displaced (pulled out) an inside position (inner position) of the apparatus main assembly to an outside position (outer position) of the apparatus main assembly. FIG. 7 is a perspective view of the apparatus main assembly A and the cartridge B when the cartridge B mounted and demounted in the state in which the openable door 13 is opened and then the tray 18 is pulled out. In FIG. 7, the cartridge B is mountable in and demountable from the tray 18 along a mounting and demounting direction E.

To the apparatus main assembly A, the openable door 13 is rotatably attached, and when the openable door 13 is opened, a cartridge inserting opening 17 is exposed. In the cartridge inserting opening 17, the tray 18 for mounting the cartridge B in the apparatus main assembly A is provided. When the tray 18 is pulled out to a predetermined position, the cartridge B can be mounted and demounted. The cartridge B is inserted (mounted) in the apparatus main assembly A along a guide rail (not shown) in an arrow C direction in FIG. 6 in a state in which the cartridge B is placed on the tray 18.

In this way, the C direction is an inserting direction (mounting direction) of the cartridge B into the apparatus main assembly A and is a movement direction of the tray 18. Strictly, the cartridge B is moved in a series of develops including horizontal and vertical directions, but in this embodiment, the C direction is shown as a representative inserting direction (mounting direction).

Figure 8:
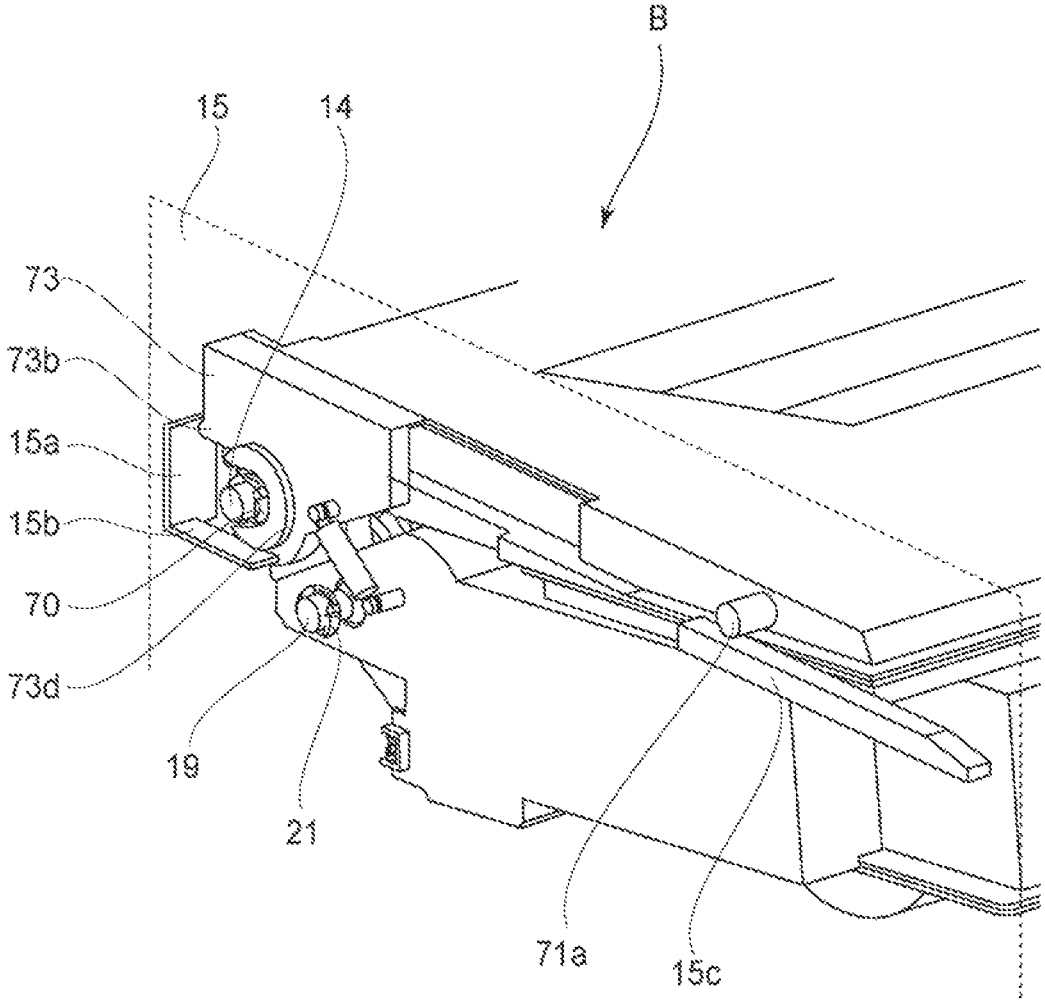
FIG. 8 is a perspective view showing a driving-side positioning portion between the process cartridge and the image forming apparatus main assembly in a state in which the process cartridge is mounted in the image forming apparatus main assembly in First Embodiment.
Figure 9:
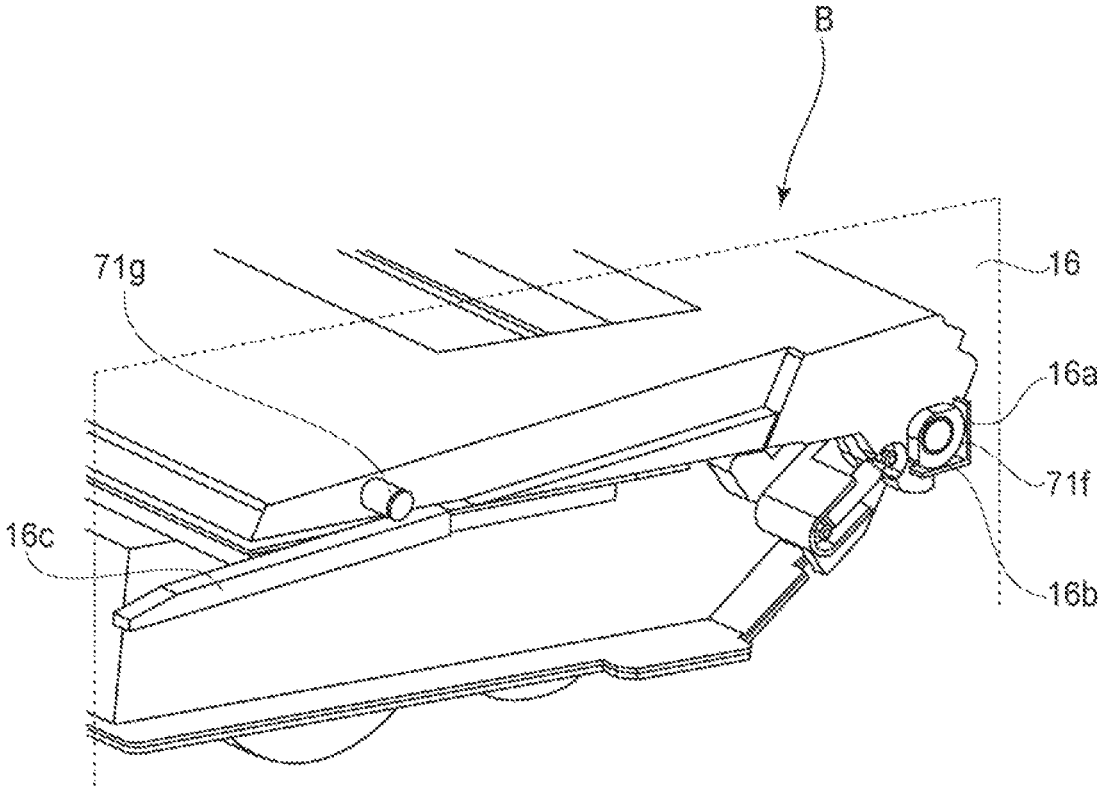
FIG. 9 is a perspective view showing a non-driving-side positioning portion between the process cartridge and the image forming apparatus main assembly in the state in which the process cartridge is mounted in the image forming apparatus main assembly in First Embodiment.

In FIG. 8, the apparatus main assembly is provided with a first main assembly(-side) driving shaft 14 and a second main assembly(-side) driving shaft 19 for transmitting a driving force to a firsts coupling 70 and a second coupling 21, respectively. The first main assembly driving shaft 14 and the second main assembly driving shaft 19 are driven by a motor (not shown) as a driving source for the apparatus main assembly A.

As a result, the drum 62 connecting with the first coupling 70 receives the driving force from the apparatus main assembly A and is rotated. The developing roller 32 is rotated by transmission of the driving force from the second coupling 21. Further, to the charging roller 66 and the developing roller 32, electric powers supplied by an electric power supplying portion (not shown) of the apparatus main assembly A.

(Support of Cartridge)

As shown in FIG. 5, the apparatus main assembly A is provided with a driving-side-side plate 15 and the non-driving-side-side plate 16 for supporting the cartridge B. The driving-side-side plate 15 is provided with a driving-side-first supporting portion 15*a*, a driving-side-second supporting portion 15*b* and a rotation supporting portion for the cartridge B. The non-driving-side-side plate 16 is provided with a non-driving-side-first supporting portion 16*a*, a non-driving-side-second supporting portion 16*b* and a rotation supporting portion 16*c* for the cartridge B.

On the other hand, as portions-to-be-supported of the cartridge B, a portion-to-be-supported 73*b* and a portion-to-be-supported 73*d* of a drum bearing member 73, and a driving-side boss 71*a*, a non-driving-side projection 71*f* and a non-driving-side boss 71*g* of the cleaning frame 71 are provided. The portion-to-be-supported 73*b* is supported by the driving-side-first supporting portion 15*a*, the portion-to-be-supported 73*d* is supported by the driving-side-second supporting portion 15*b*, and the driving-side boss 71*a* is supported by the rotation supporting portion 15*c*. Further, the non-driving-side projection 71*f* is supported by the non-driving-side-first supporting portion 16*a* and the non-driving-side-second supporting portion 16*b*, and the non-driving-side boss 71*g* is supported by the rotation supporting portion 16*c*, so that the cartridge B is positioned inside the apparatus main assembly.

(General Structure of Cartridge)

Figure 11:
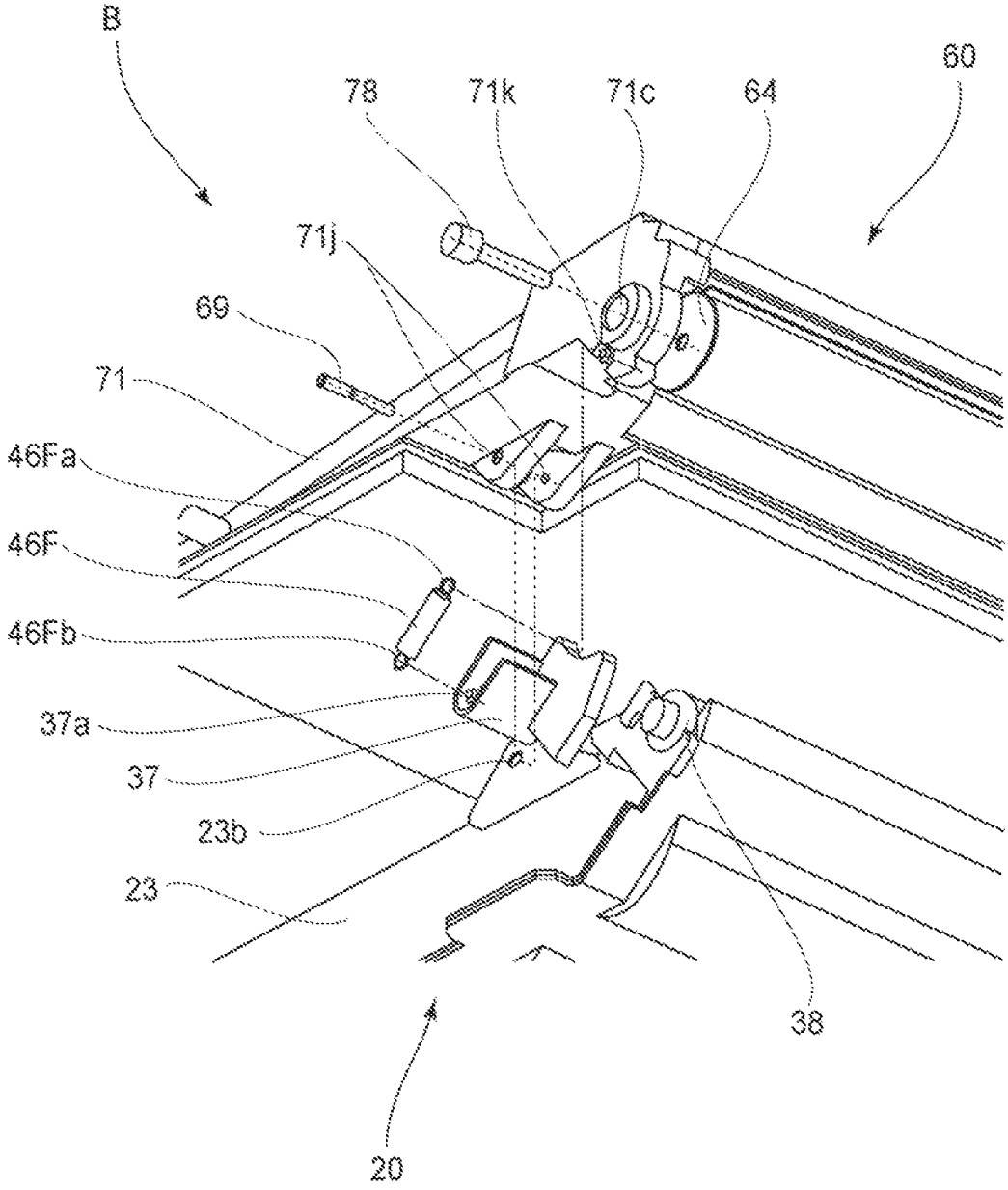
Figure 12:
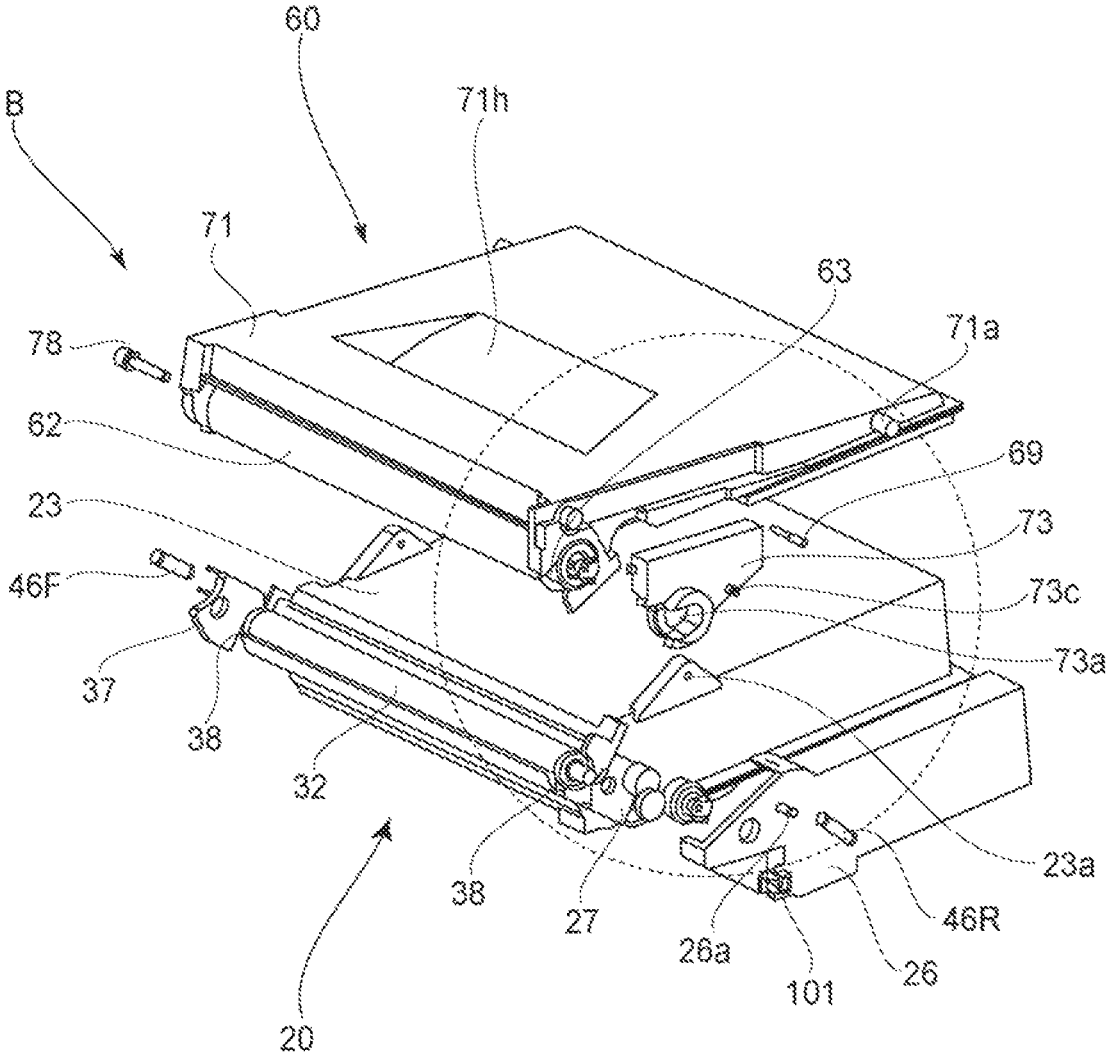
Figure 13:
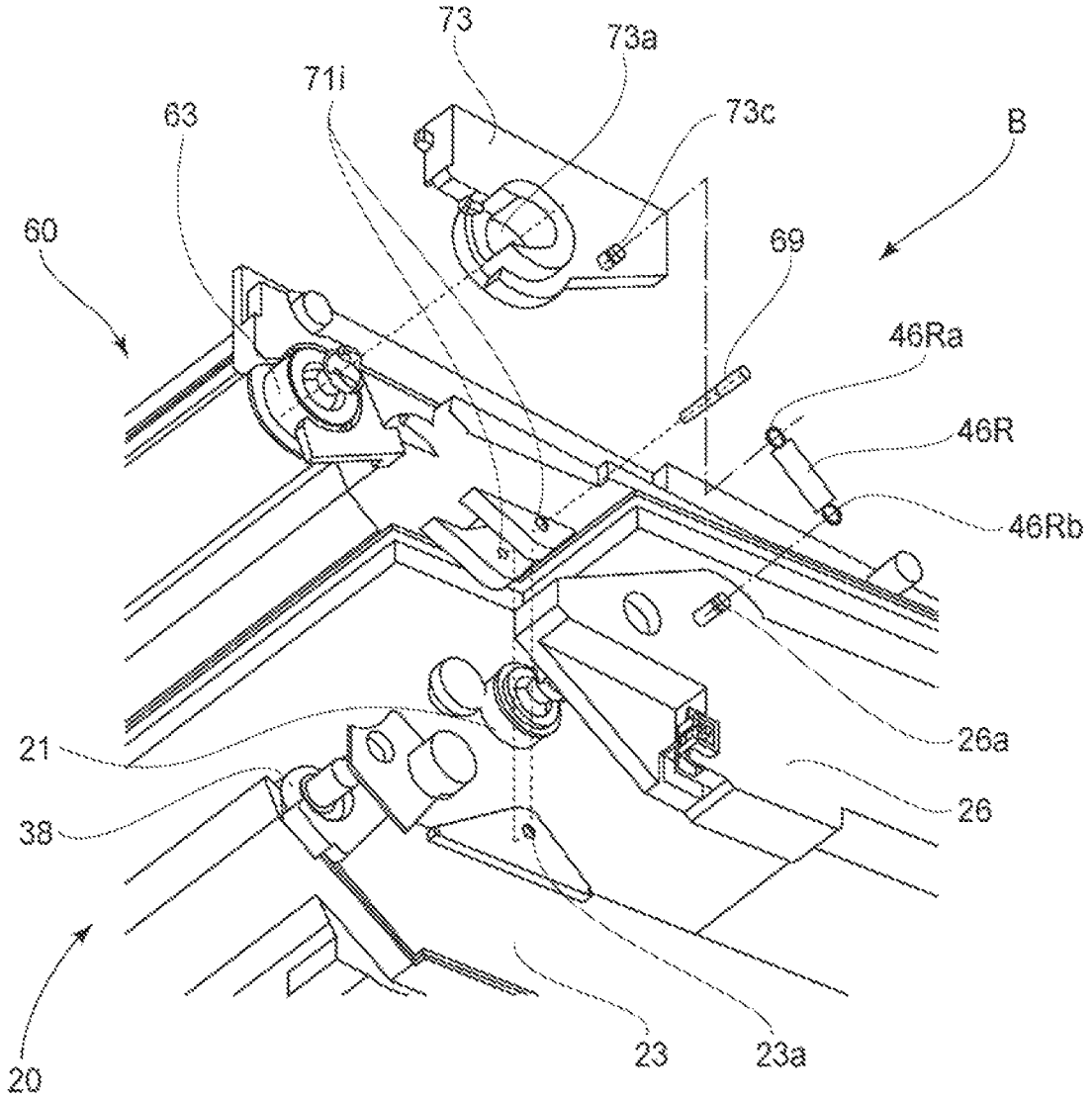

A general structure of the cartridge B will be described using FIGS. 3, 4 and 10 to 13. FIG. 3 is a sectional view of the cartridge B, and FIGS. 10 to 13 are perspective views for illustrating a structure of the cartridge B. FIGS. 11 and 13 are partly enlarged perspective views showing dotted circuit portions in FIGS. 10 and 12, respectively, as seen from different angles. In this embodiment, description will be made by omitting screws during connection of respective components.

Figure 10:
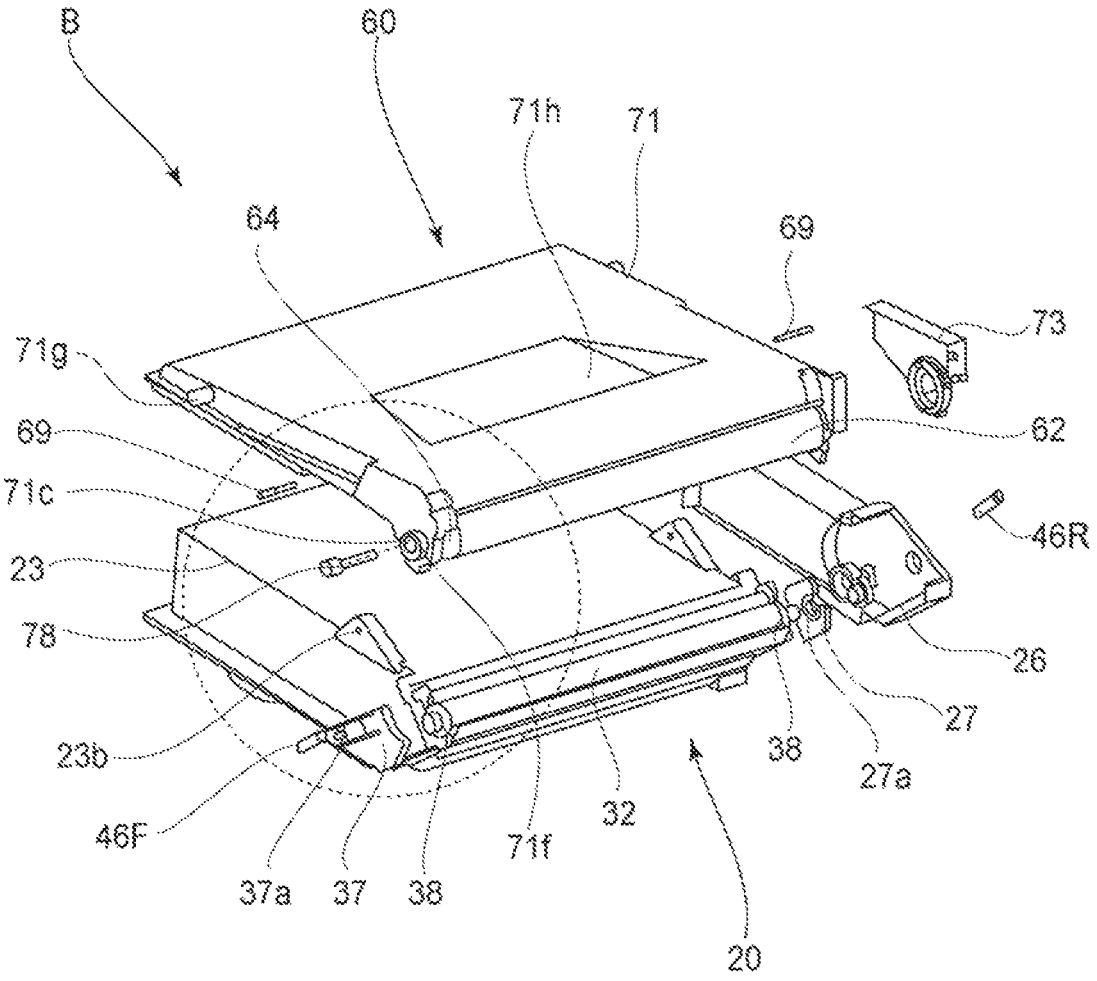
FIGS. 10 to 13 are exploded perspective views each showing the process cartridge in First Embodiment.

In FIG. 10, the cartridge B which is the process cartridge includes the cleaning unit 60 and the developing unit 20. In general, the process cartridge is prepared by integrally assembling the photosensitive drum and at least one of the chambering means, the developing means and the cleaning means which are process means actable on the photosensitive drum, into a unit (cartridge) which is detachably mountable to the main assembly of the image forming apparatus.

In this embodiment, the cartridge B which is the process cartridge at least includes the cleaning unit 60. That is, as shown in FIG. 3, the cleaning unit 60 includes the drum 62, the charging roller 66, the cleaning member 77, the cleaning frame 71 supporting these members, and a cap member 72 fixed to the cleaning frame 71 by welding or the like. In the cleaning unit 60, the charging roller 66 and the cleaning member 77 are disposed in contact with the outer peripheral surface of the drum 62.

The cleaning member 77 includes a rubber blade 77*a* which is a blade-shaped elastic member formed of a rubber as an elastic material, and a supporting member 77*b* for supporting the rubber blade 77*a*. The rubber blade 77*a* is contacted to the drum 62 counterdirectionally to a rotational direction of the drum 62. That is, the rubber blade 77*a* is contacted to the drum 62 so that a free end portion thereof is directed upward with respect to the rotational direction of the drum 62.

The residual toner removed from the surface of the drum 62 by the cleaning member 77 is fed by a first screw 86, a second screw 87 and a third screw 88 which are residual toner feeding members. Then, the residual toner is accumulated in a residual toner chamber 71*b* formed by the cleaning frame 71 and the cap member 72. The first screw 86 receives the driving force transmitted from the coupling 21 shown in FIG. 13 by a gear (not shown), and thus is rotated.

The second screw 87 and the third screw 88 are rotated by receiving the driving force from the first screw 86 and the second screw 87, respectively. The first screw 86 is disposed in the neighborhood of the drum 62, the second screw 87 is disposed at a longitudinal end portion of the cleaning frame 71, and the third screw 88 is disposed inside the residual toner chamber 71*b*. Here, a rotational axis of the first screw 86 and a rotational axis of the third screw 88 are parallel to a rotational axis of the drum 62, and a rotational axis of the second screw 87 is perpendicular to the rotational axis of the drum 61.

Incidentally, as shown in FIG. 3, a drum contact sheet 65 for preventing leakage of the residual toner from the cleaning frame 71 is provided at an edge portion of the cleaning frame 71 so as to contact the drum 62.

The drum 62 is rotationally driven in the arrow R direction in FIG. 3 depending on the image forming operation by receiving the driving force from a main assembly driving motor (not shown) which is a driving source. The charging roller 66 is rotatably mounted in the cleaning unit 60 via a charging roller bearing 67 in each of end portion sides with respect to a longitudinal direction (substantially parallel to a rotational axis direction of the drum 62) of the cleaning frame 71. The charging roller 66 is press-contacted to the drum 62 by pressing the charging roller bearing 67 toward the drum 62 by an urging member 68. The charging roller 66 is rotated by the rotation of the drum 62.

As shown in FIG. 3, the developing unit 20 includes the developing roller 32, the developing container 23 for supporting the developing roller 32, a developing blade 42, and the like. Inside the developing roller 32, a magnet roller 34 is provided. In the developing unit 20, the developing blade 42 for regulating a toner layer on the developing roller 32 is disposed. As shown in FIGS. 10 and 12, a gap holding member 38 is mounted to each of end portions of the developing roller 32, and by contact of the gap holding member 38 with the drum 62, the developing roller 32 is held with a predetermined minute gap with the drum 62.

Further, as shown in FIG. 3, a developing roller contact sheet 33 for preventing leakage of the toner from the developing unit 20 is provided in contact with the developing roller 32 at an edge portion of a bottom member 22. Further, in the toner chamber 29 formed by the developing container 23 and the bottom member 22, the first to third feeding members 43, 44 and 50 are provided. The first to third feeding members 43, 44 and 50 not only stir the toner accommodated in the toner chamber 29 but also feed the toner to the toner supplying chamber 28.

As shown in FIGS. 10 and 12, the cartridge B is constituted by combining the cleaning unit 60 and the developing unit 20. The cleaning unit 60 includes the cleaning frame 71, the cap member 72, the drum 62, the drum bearing 73 and the drum shaft 78 which are used for rotatably supporting the drum 62. As shown in FIG. 13, in the driving side of the drum 62, a driving-side drum flange 63 is rotatably supported by a first bearing portion 73*a* (image bearing member bearing portion) of the drum bearing member 73.

On the other hand, as shown in FIG. 11, in the non-driving side, a constitution in which a hole (not shown) of a non-driving-side drum flange 64 is rotatably supported by the drum shaft 78 press-fitted in a hole 71*c* provided in the cleaning frame 71 is employed.

On the other hand, as shown in FIGS. 3, 10 and 12, the developing unit 20 includes the bottom member 22, the developing container 23, the driving-side-developing side member 26, the developing blade 42, the developing roller 32 and the like. Further, bearing members 27 and 37 for rotating the developing roller 32 are attached to the developing container 23.

As shown in FIG. 10, in the non-driving side, the developing roller 32 is rotatably supported by a second bearing portion 27*a* (developing bearing portion) of the bearing member 27.

Then, as shown in FIGS. 11 and 13, the cartridge B is constituted by rotatably connecting the cleaning unit 60 and the developing unit 20 by connecting pin 69 relative to each other. Specifically, a developing-first supporting hole 23*a* and a developing-second supporting hole 23*b* are provided in members formed on the developing container 23 at longitudinal end portions of the developing unit 20. Further, at longitudinal end portions of the cleaning unit 60, first hanging holes 71*i* and second hanging holes 71*j* are provided in members formed on the cleaning frame 71.

Then, by engagement of the connecting pin 69 press-fitted and fixed in the first hanging holes 71*i* and the second hanging holes 71*j* with the first supporting hole 23*a* and the second supporting hole 23*b*, the cleaning unit 60 and the developing unit 20 are rotatably connected with each other.

Further, a first hole 46Ra of a driving-side-urging member 46R is hooked on a boss 73*c* of the drum bearing member 73, and a second hole 46Rb of the driving-side-urging member 46R is hooked on a boss 26*a* of the driving-side-developing side member 26. Further, a first hole 46Fa of a non-driving-side-urging member 46F is hooked on a boss 71*k* of the cleaning frame 71, and a second hole 46Fb of the non-driving-side-urging member 46F is hooked on a boss 37*a* of the bearing member 37.

In this embodiment, each of the driving-side-urging member 46R and the non-driving-side-urging member 46F is formed with a tension spring. The developing unit 20 is urged toward the cleaning unit 60 by an urging force of these springs, so that the developing roller 32 is constituted so as to be pressed toward the drum 62 with reliability. Then, by the gap holding member 38 provided at each of the end portions of the developing roller 32, the developing roller 32 is held with a predetermined minute gap with the drum 62.

(Structure of Storing Medium and Mounted Structure of Storing Medium)

Figure 1:
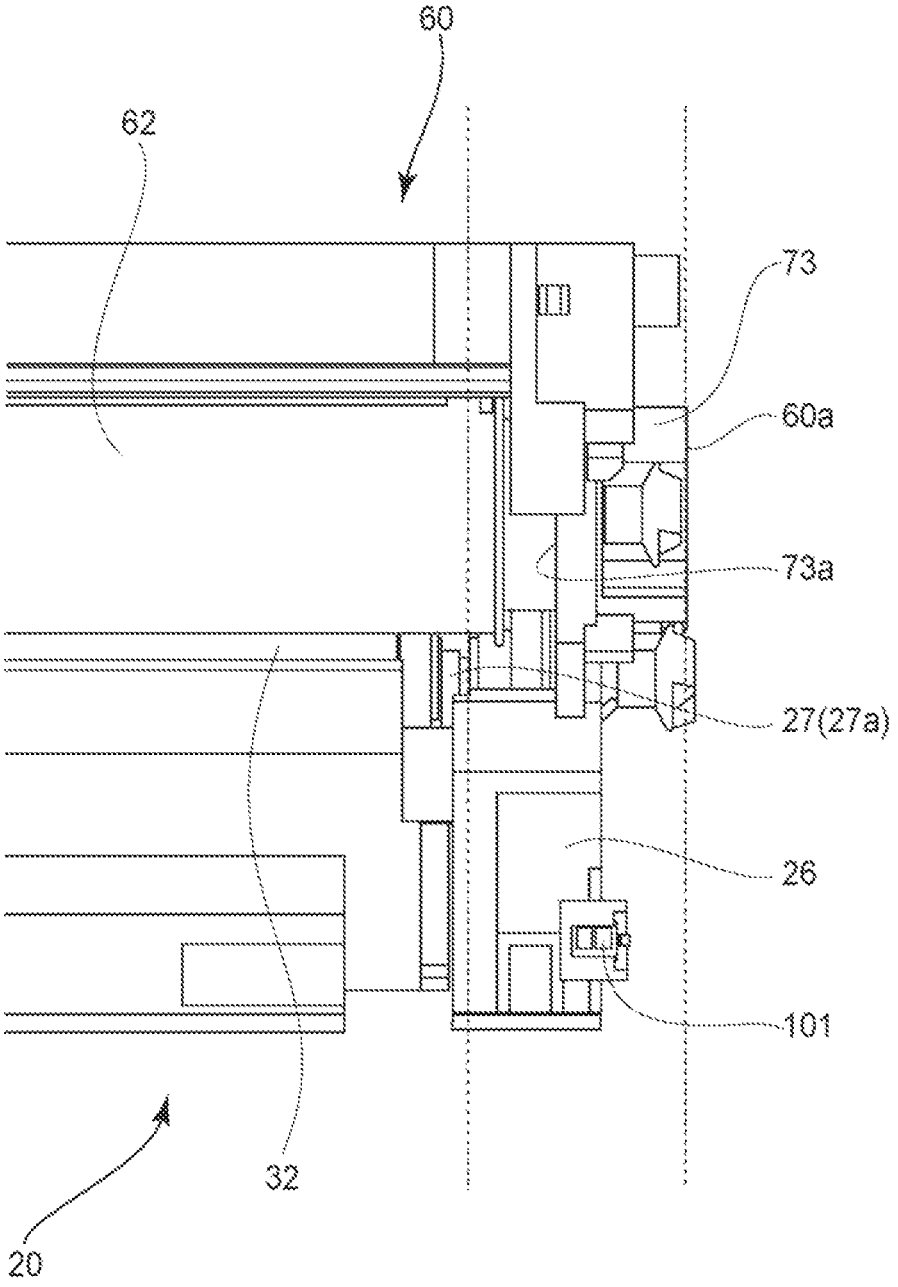
FIG. 1 is a schematic view of a process cartridge according to First Embodiment to which the present invention is applicable, as seen from a downstream side with respect to an inserting direction.
Figure 21A:
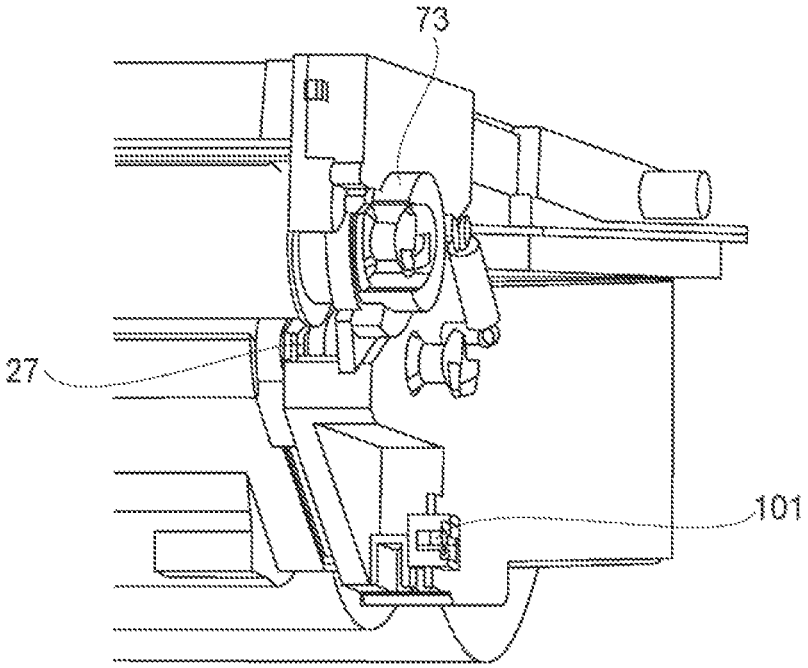
In FIG. 21, (*a*) is a schematic view for illustrating mounting of the storing medium, and (*b*) is a schematic view for illustrating a mounting range of the storing medium with respect to a rotational axis direction.
Figure 21B:
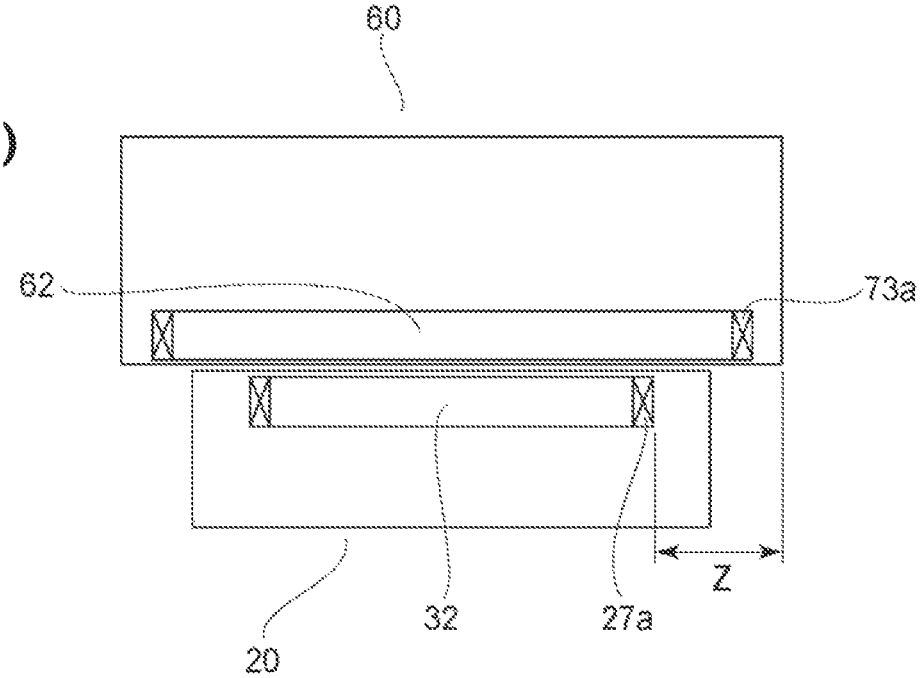

A storing medium 101 (including a substrate in which a storing element is provided and on which electrical contacts are provided) to be mounted on the cartridge B will be described using FIGS. 1, 12, 14, 15 and (*a*) of FIG. 21. FIG. 1 is a schematic view of the cartridge B as seen from a downstream side with respect to the inserting direction, and (*a*) and (*b*) of FIG. 15 are front view and a side view, respectively, of the driving-side developing side member 26 before mounting of the storing medium 101. In FIG. 21, (*a*) is a schematic view for illustrating the mounting of the storing medium 101.

Figure 14:
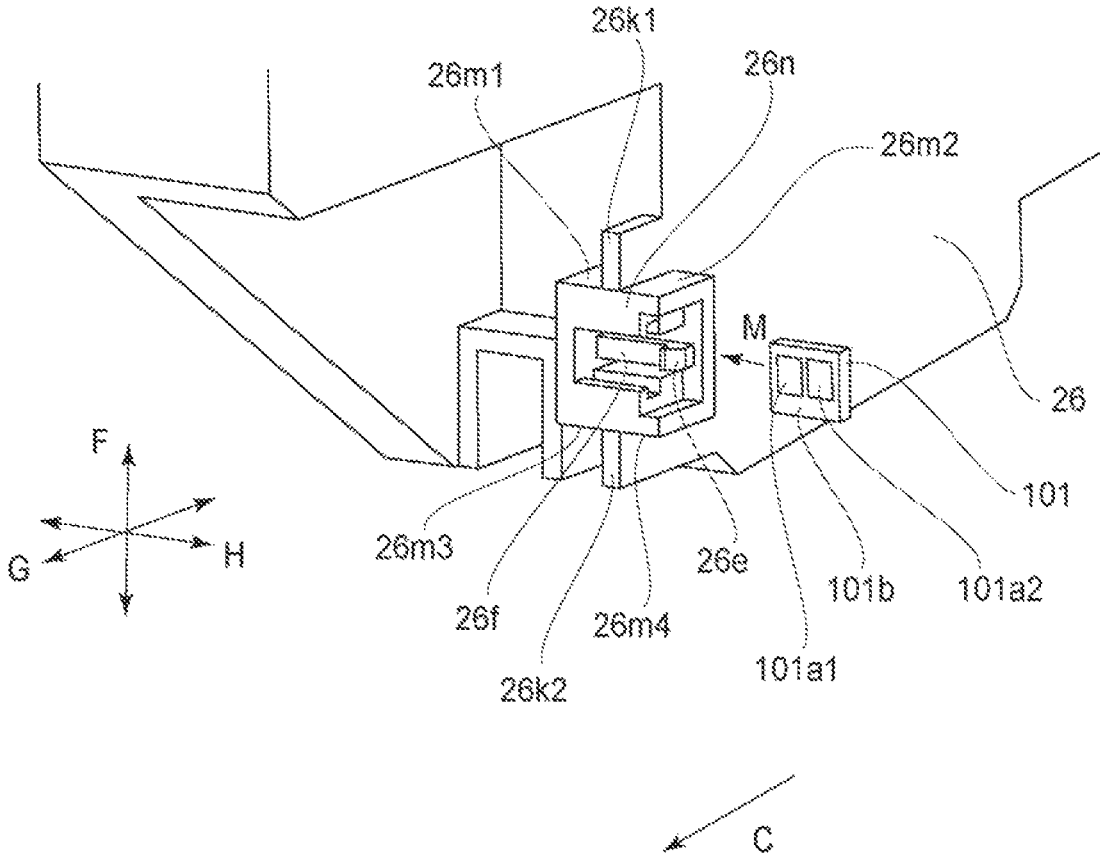
FIG. 14 is a perspective view for illustrating a state of assembling of a storing medium in First Embodiment.
Figure 15A:
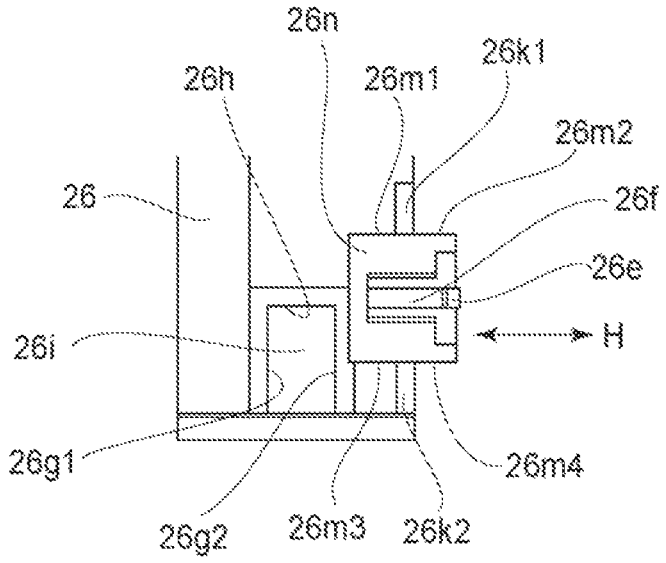
In FIG. 15, (*a*) and (*b*) are a front view and a side view, respectively, of a driving-side developing side member before mounting of the storing medium in First Embodiment.
Figure 15B:
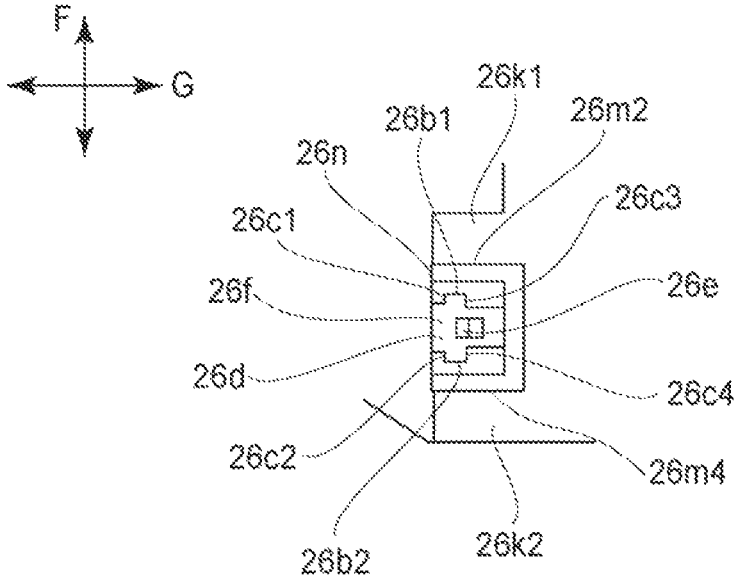

In FIG. 14, an F direction is an up-down direction, a G direction is a front-rear direction, and an H direction is a left-right direction (rotational axis direction of the drum 62). A C direction is the inserting direction (mounting direction) of the cartridge B into the apparatus main assembly, and is also a movement direction of the tray 18.

In this embodiment, the cartridge B as the process cartridge includes the cleaning unit 60 (first unit, image bearing member unit) including the first bearing portion 73*a* for supporting the drum 62 (image bearing member). Further, the cartridge B includes the developing unit 20 (second unit, developer carrying member unit) including the second bearing portion 27*a* for supporting the developing roller 32 (developer carrying member). The storing medium 101 is supported by the developing unit 20 (second unit).

As shown in FIG. 1, FIG. 10 and FIG. 12, with respect to the rotational axis direction of the drum 62, the second bearing portion 27*a* of the bearing member 27 for supporting the developing roller 32 is positioned inside the first bearing portion 73*a* of the drum bearing member 73 for supporting the drum 62. The first bearing portion 73*a* and the second bearing portion 27*a* are surface portions of holes for shaft-supporting the drum 62 and the developing roller 32, respectively.

The storing medium 101 is supported by the driving-side developing side member 26 of the developing unit 20 and is disposed outside the second bearing portion 27*a* and inside an outer configuration 60*a* of the cleaning unit 60 with respect to the rotational axis direction of the drum 62. A mounting range of the storing medium 101 with respect to the rotational axis direction in this case is shown in (*b*) of FIG. 21 as a schematic view.

In this embodiment, the storing medium 101 is disposed in a position at an end portion of the developing unit 20, with respect to the rotational axis direction, which is inside a range Z and which supports the storing medium 101. The storing medium 101 may also be provided so that at least a part thereof is disposed between the bearing portion (first bearing portion 73*a*) of one unit and the bearing portion (second bearing portion 27*a*) of the other unit.

The storing medium 101 is provided below and upstream of the drum 62 with respect to the inserting direction of the cartridge B into the apparatus main assembly A (FIG. 4), and is provided with an inserting opening with respect to the rotational axis direction of the drum 62 (FIG. 14).

As shown in FIG. 14, the storing medium 101 which is a storing element such as RAM or ROM includes, as described later, electrical contacts (as a plurality of contact portions 101*a*1, 101*a*2) formed on a substrate 101*b* in a downstream side with respect to a feeding direction (mounting direction of the tray into the apparatus main assembly). In this storing medium 101, information B on the cartridge B is inputted in advance, and when the cartridge B is mounted in the image forming apparatus main assembly A, the information is transferred between itself and the apparatus main assembly A. That is, the storing medium 101 is used for the purposes that a state such as an operation status of the cartridge B is notified to a control substrate (not shown) of the image forming apparatus to be used for the image forming operation and that the state of the cartridge B is displayed for an operator (user).

Further, writing in the storing medium 101 can be made even during use, and therefore the writing is made in real time as desired. The contact portions 101*a*1, 101*a*2 are used for being connected with a main assembly(-side) contact 102, described later, of the apparatus main assembly A in order to read and write the information with respect to the storing medium 101.

As shown in FIG. 14 and (*b*) of FIG. 15, the driving-side developing side member 26 is provided with an inserting groove 26*f* as an inserting opening defined by first storing medium limiting surfaces 26*b*1, 26*b*2 and second storing medium limiting surfaces 26*c*1, 26*c*2, 26*c*3, 26*c*4. When the storing medium 101 is inserted during mounting, the inserting groove 26*f* as the inserting opening is not positioned at a lower portion with respect to the direction of gravity, and therefore there is such an advantage that the storing medium 101 does not readily drop. The inserting groove 26*f* is provided with a third storing medium limiting surface 26*d* in a rear side and a snap-fit portion 26*e* in an entrance side.

In the neighborhood of the inserting groove 26*f*, a roughly guiding groove 26*i* defined by first holder limiting surfaces 26*g*1, 26*g*2 and a second holder limiting surfaces 26*h* which are used for limiting (regulating) a position of a first holder member, described later, provided in the apparatus main assembly A side. Further, in the neighborhood of the inserting groove 26*f*, positioning ribs 26*k*1, 26*k*2, positioning surfaces 26*m*1, 26*m*2, 26*m*3, 26*m*4 and an abutting surface 26*n* which are used for limiting (regulating) a position of the main assembly contact 102, described later, provided in the apparatus main assembly A side.

A method of fixing the storing medium 101 on the driving-side developing side member 26 will be described using FIGS. 14 and 15. When the storing medium 101 is inserted toward the inserting groove 26*f* in the arrow M direction (FIG. 14) while elastically deforming the snap-fit portion 26*e*, the position of the storing medium 101 with respect to the arrow F direction ((*b*) of FIG. 15) which is the up-down direction is limited by the first storing medium limiting surfaces 26*b*1, 26*b*2.

Further, the position of the storing medium 101 with respect to the arrow G direction ((*b*) of FIG. 15) is limited by the second storing medium limiting surfaces 26*c*1, 26*c*2, 26*c*3, 26*c*4. Further, the position of the storing medium 101 with respect to the arrow H direction ((*a*) of FIG. 15) is limited by the third storing medium limiting surface 26*d* and the snap-fit portion 26*e*. In this way, the storing medium 101 is fixed on the driving-side developing side member 26.

(Structure of Main Assembly Contact and Mounted Structure of Main Assembly Contact)

Figure 16:
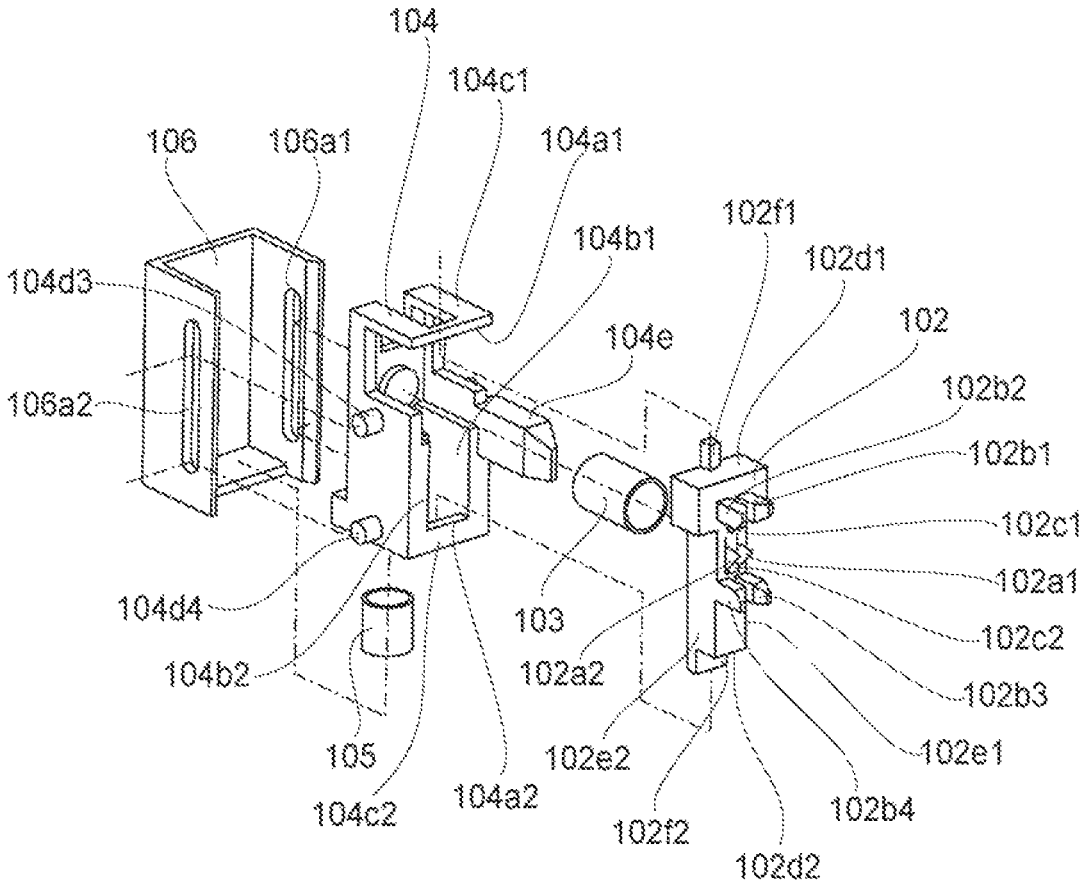
FIG. 16 is an exploded perspective view of a main assembly contact, a first holder member and a second holder member in First Embodiment.
Figure 17A:
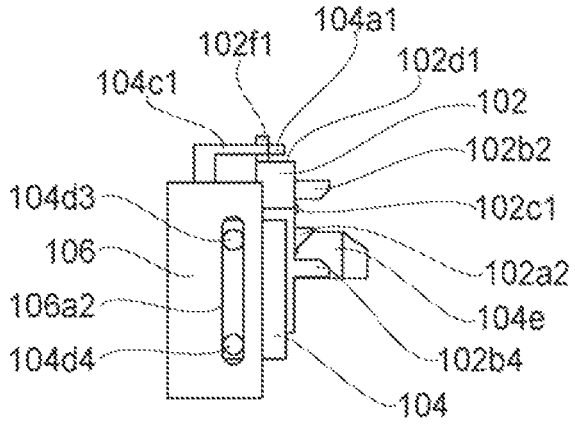
In FIG. 17, (*a*) and (*b*) are schematic views each showing an assembled state of the main assembly contact, the first holder member and the second holder member in First Embodiment.
Figure 17B:
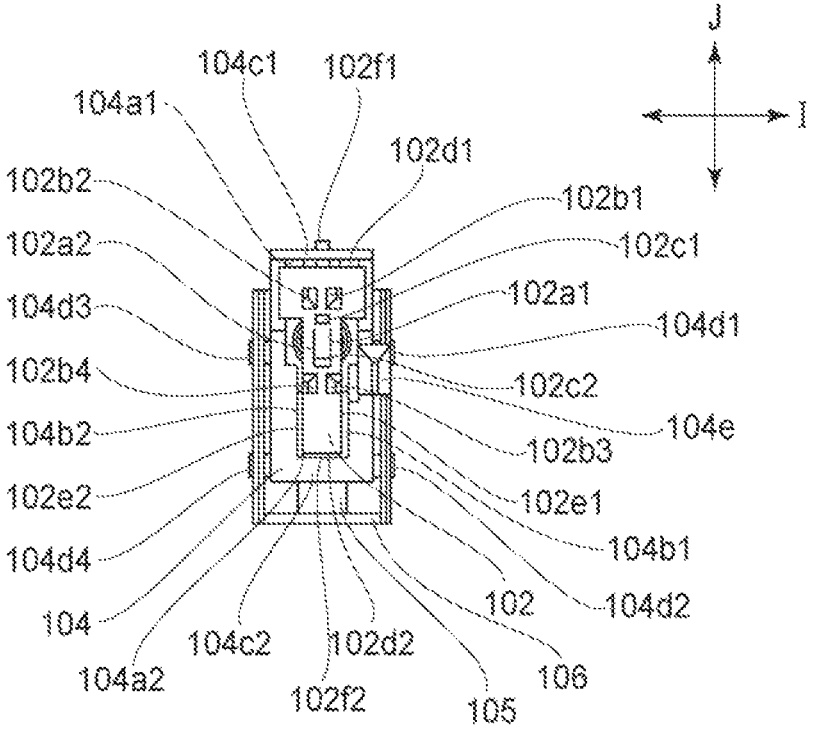

A structure of the main assembly contact 102 provided in the apparatus main assembly A and a mounted structure of the main assembly contact will be described using FIGS. 16 and 17. FIG. 16 is an exploded perspective view of the main assembly contact 102, a spring 103, the first holder member 104, a spring 105 and a second holder member 106. In FIG. 17, (*a*) and (*b*) are schematic views for illustrating an assembled (mounted) state of the main assembly contact 103, the first holder member 104 and the second holder member 106, in which (*a*) is a side view, and (*b*) is a front view.

The main assembly contact 102 is provided with triangular contact portions 102*a*1, 102*a*2 each constituted by a spring material to be electrically connected with the storing medium 101. Each of the contact portions 102*a*1, 102*a*2 each having a spring property is connected electrically with the control substrate in the apparatus main assembly A side via a bundle wire (not shown).

The main assembly contact 102 is provided at the contact portions 102*a*1, 102*a*2 with projected portions-to-be-positioned 102*b*1, 102*b*2, 102*b*3, 102*b*4 for positioning relative to the driving-side developing side member 26 with respect to the up-down direction. Further, the main assembly contact 102 is provided with surfaces-to-be-abutted 102*c*1, 102*c*2 to which an abutting surface 26*n* (FIG. 14) of the driving-side developing side member 26 is contacted.

In FIG. 16 and (*b*) of FIG. 17, the main assembly contact 102 is provided, with respect to the up-down direction, with first limiting portions 102*d*1, 102*d*2 for positioning relative to the first holder member 104 and with disengagement limiting portions 102*f*1, 102*f*2 for limiting (preventing) disengagement thereof. Further, the main assembly contact 102 is provided, with respect to the left-right direction (perpendicular to the cartridge inserting direction), with second limiting portions 102*e*1, 102*e*2 for positioning relative to the first holder member 104.

On the other hand, the first holder member 104 is provided with first limiting portions 104*a*1, 104*a*2 for positioning relative to the main assembly contact 102 with respect to the up-down direction and disengagement limiting portions 104*c*1, 104*c*2 for limiting disengagement. Further, the first holder member 104 is provided with second limiting portions 104*b*1, 104*b*2 for positioning relative to the main assembly contact 102 with respect to the left-right direction.

In FIG. 16 and (*b*) of FIG. 17, the first holder member 104 is provided with limiting bosses 104*d*1, 104*d*2, 104*d*3, 104*d*4 for positioning relative to the second holder member 106. Further the first holder member 104 is provided with a projected portion 104*e* (FIGS. 14 and 16) engaging with the roughly guiding groove 26*i* ((*a*) of FIG. 15) of the driving-side developing side member 26. On the other hand, the second holder member 106 is provided, for positioning relative to the first holder member 104, with elongated holes 106*a*1, 106*a*2 in which the limiting bosses 104*d*1, 104*d*2, 104*d*3, 104*d*4 are inserted.

(Assembled Structure of Main Assembly Contact, First Holder Member and Second Holder Member)

An assembled structure of the main assembly contact 102, the first holder member 104 and the second holder member 106 will be described using FIGS. 16 and 17.

First, in FIG. 16, the main assembly contact 102 is assembled with the first holder member 104 in a state in which the spring 103 urged in the cartridge inserting direction (perpendicular to the I direction and the J direction in FIG. 17) is sandwiched therebetween. At this time, by engagement of the first limiting portions 102*d*1, 102*d*2 with the first limiting portions 104*a*1, 104*a*2 with respect to the up-down direction, the main assembly contact 102 is positionally limited (regulated) with play with respect to the up-down direction (arrow J direction in FIG. 17).

Further, by engagement of the second limiting portions 102*e*1, 102*e*2 of the main assembly contact 102 with the second limiting portions 104*b*1, 104*b*2 of the first holder member 104 with respect to the left-right direction, the main assembly contact 102 is positionally limited (regulated) with play with respect to the left-right direction (arrow I direction in FIG. 17).

Further, by contact of the disengagement limiting portions 102*f*1, 102*f*2 of the main assembly contact 102 with the disengagement limiting portions 104*c*1, 104*c*2 of the first holder member 104, the main assembly contact 102 receives an urging force of the spring 103 urged in the cartridge inserting direction.

The first holder member 104 is assembled with the second holder member 106 in a state in which the spring 105 urged in the up-down direction (J direction in FIG. 17) is sandwiched therebetween. At this time, by engagement of the limiting bosses 104*d*1, 104*d*2, 104*d*3, 104*d*4 of the first holder member 104 with the elongated holes 106*a*1, 106*a*2 of the second holder member 106, the first holder member 104 is movable in the up-down direction (J direction in FIG. 17).

(Connecting Operation Between Storing Medium and Main Assembly Contact)

Figure 18A:
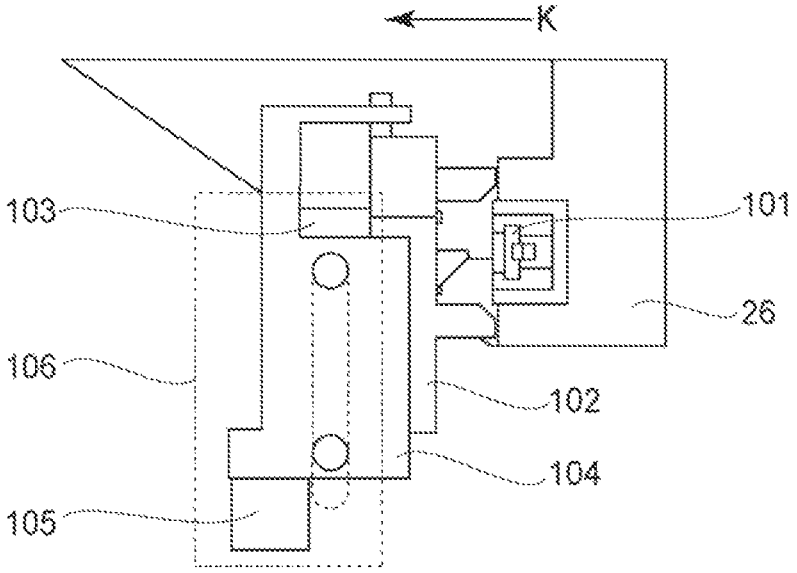
In FIG. 18, (*a*) and (*b*) are schematic views each showing a state of connection between the main assembly contact and the storing medium in First Embodiment.
Figure 18B:
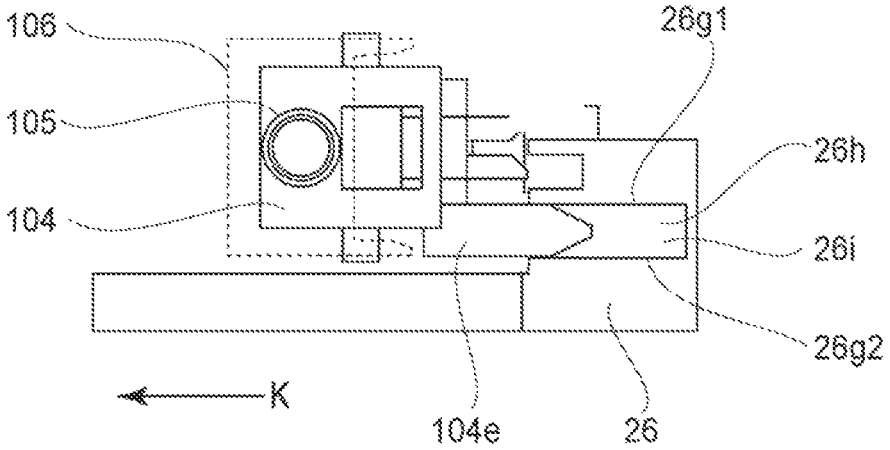
Figure 19A:
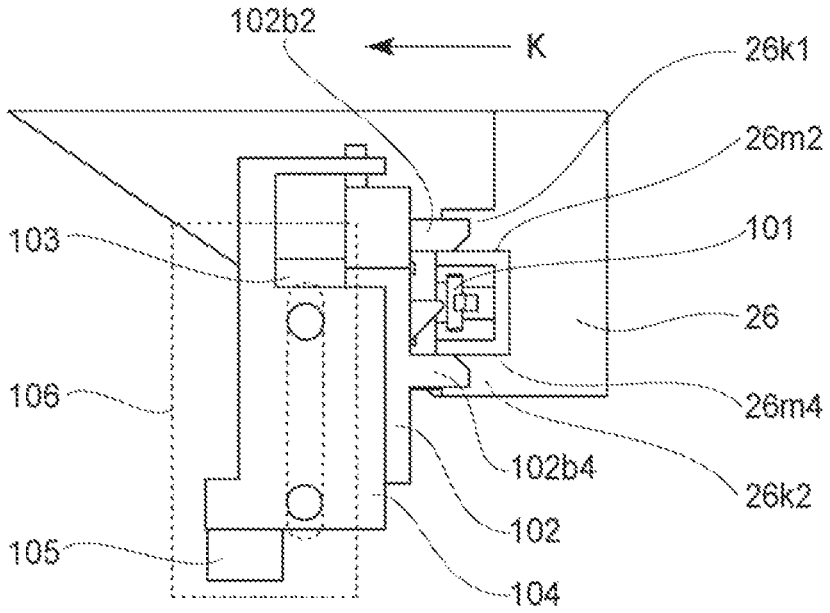
In FIG. 19, (*a*) and (*b*) are schematic views each showing the state of connection between the main assembly contact and the storing medium in First Embodiment.
Figure 19B:
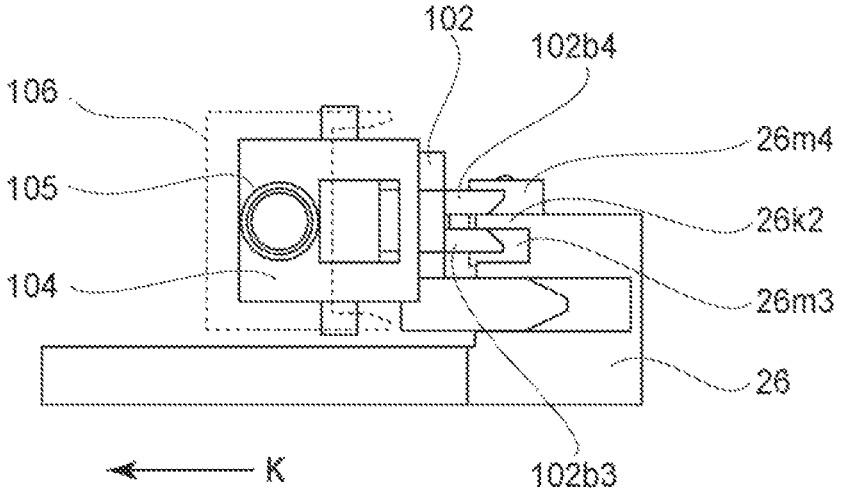
Figure 20A:
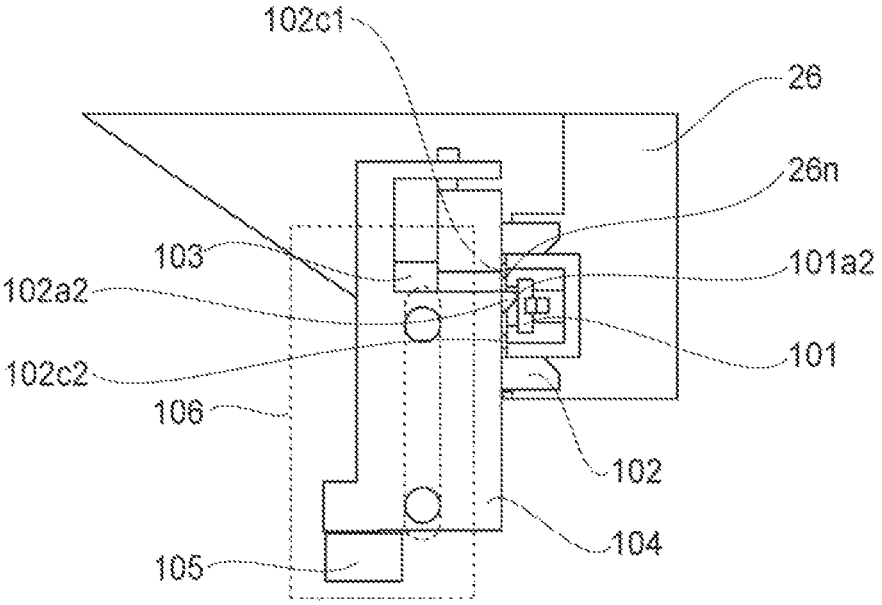
In FIG. 20, (*a*) and (*b*) are schematic views each showing the state of connection between the main assembly contact and the storing medium in First Embodiment.
Figure 20B:
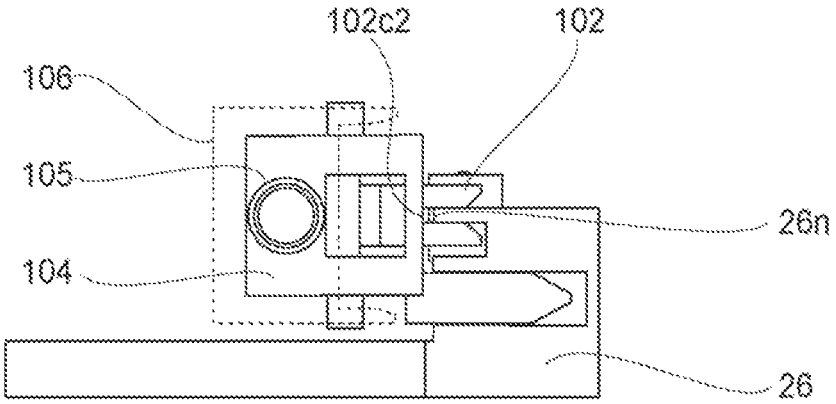

A connecting operation between the storing medium 101 and the main assembly contact 102 will be described using FIGS. 14, 16, 18, 19 and 20. FIGS. 18 to 20 are schematic views for illustrating a state in which the main assembly contact 102 and the storing medium 102 are connected with each other, in which (*a*) of FIG. 18, (*a*) of FIG. 19 and (*a*) of FIG. 20 are side views, and (*b*) of FIG. 18, (*b*) of FIG. 19 and (*b*) of FIG. 20 are bottom views.

First, in (*a*) and (*b*) of FIG. 18, when the cartridge B is inserted in the arrow K direction (inserting direction of the cartridge B), the projected portion 104*e* (FIG. 14, FIG. 16, (*b*) of FIG. 18) enters the roughly guiding groove 26*i* ((*a*) of FIG. 15) of the driving-side developing side member 26. Then, the first limiting surfaces 26*g*1, 26*g*2 ((*b*) of FIG. 18 which is the bottom view) of the driving-side developing side member 26 sandwich the projected portion 104*e*, so that a longitudinal position of the first holder member 104 is limited relative to the driving-side developing side member 26.

Then, the second limiting surface 26*h* ((*a*) of FIG. 15, (*b*) of FIG. 18) of the driving-side developing side member 26 presses down the projected portion 104*e*, so that the first holder member 104 follows the driving-side developing side member 26 and moves downward while compressing the spring 105 (FIG. 16).

When the cartridge B is further inserted in the arrow K direction, the positioning ribs 26*k*1, 26*k*2 and the positioning surfaces 26*m*1, 26*m*2, 26*m*3, 26*m*4 of the driving-side developing side member 26 shown in FIG. 14 enter the projected portions-to-be-positioned 102*b*1, 102*b*2, 102*b*3, 102*b*4 of the main assembly contact 102. As a result, the driving-side developing side member 26 and the main assembly contact 102 are positioned relative to each other with high accuracy.

Then, when the mounting of the cartridge B in the apparatus main assembly A is completed, the abutting surface 26*j* (FIGS. 14 and 20) of the driving-side developing side member 26 contacts the surfaces-to-be-abutted 102*c*1, 102*c*2 (FIG. 16) of the main assembly contact 102, so that the spring 103 (FIG. 16) is compressed. Further, by the contact of the contact portions 101*a*1, 101*a*2 of the storing medium 101, the triangular contact portions 102*a*1, 102*a*2, of the main assembly contact 102, constituted by the spring material are compressed.

Here, the urging force of the spring 103 (FIG. 16) is set to be larger than a total value of urging forces of the contact portions 102*a*1, 102*a*2 of the main assembly contact 102, and therefore it is possible to ensure a desired contact pressure between the storing medium 101 and the main assembly contact 102.

As described above, in this embodiment, the storing medium 101 and the positioning constitution were provided in a range created by a difference in length between the cleaning unit 60 and the developing unit 20. As a result, there is no need to newly provide a space for positioning the main assembly contact 102 of the apparatus main assembly A and the storing medium 101 relative to each other. Therefore, it is possible to realize not only stable electrical connection but also downsizing and cost reduction of the apparatus main assembly A and the cartridge B.

(Arrangement Direction of Electrical Contacts of Storing Medium)

In this embodiment, as shown in FIGS. 18 to 20, at least the contact portions 101*a*1, 101*a*2 which are the electrical contacts of the storing medium 101 are disposed toward the downstream side with respect to the inserting direction (mounting direction) of the cartridge B. For that reason, the storing medium 101 and the main assembly contact 102 can be connected with each other with a simple constitution.

That is, in the case where the cartridge B is seen from the downstream side with respect to the inserting direction, a state in which the electrical contacts of the storing medium 101 are in sight is created. Each of the electrical contacts has a plurality of surfaces in some cases, and in this embodiment, a state in which a broadest surface is in sight. The broadest surface is not limited to the case where the surface is disposed at a position perpendicular to the inserting direction, but may also be inclined with respect to the inserting direction.

Unless the contact portions 101*a*1 and 101*a*2 are directed toward the downstream side with respect to the inserting direction, there is a possibility that there is a need to provide a mechanism for causing the main assembly contact 102 to follow the storing medium 101 also with respect to the inserting direction of the cartridge B. Alternatively, there is a possibility that there is a need to provide a mechanism for engaging the main assembly contact 102 with the storing medium 101 in interrelation with a closing operation of the openable door 13 after the mounting of the cartridge B is completed.

In this embodiment, the inserting direction of the cartridge B, the positioning direction between the storing medium 101 and the main assembly contact 102 and the compression direction of the contact portions 102*a*1 and 102*a*2 of the main assembly contact 102 are coincide with each other, so that there is no need to provide the above-described mechanisms for causing the main assembly contact 102 to follow and engage with the storing medium 101. Here, the term "toward the downstream side" not only means the case where the contact portions 101*a*1, 101*a*2 correctly oppose the electrical contacts in the apparatus main assembly A but also may include the case where the contact portions 101*a*1, 101*a*2 obliquely oppose the electrical contacts in the apparatus main assembly A.

Modified Embodiments

The preferred embodiment of the present invention was described above, but the present invention is not limited thereto. Various modifications and changes of constitutions of the direction are possible within the scope of the present invention. Incidentally, with respect to functions, materials, shapes and relative arrangement of constituent elements described in the above embodiments, the scope of the present invention is not intended to be limited only to these parameters.

Modified Embodiment 1

In the above-described embodiment, the constitution in which the bearing member 27 as the second bearing portion for supporting the developing roller 32 was positioned inside the first bearing portion 73*a* of the drum bearing member 73 for supporting the drum 62 was described. However, the present invention may also be applied to an opposite constitution in which a longitudinal positional relationship is opposite to that in the above-embodiment, i.e., a constitution in which the first bearing portion 73*a* of the drum bearing member 73 for supporting the drum 62 is positioned inside the second bearing portion 27*a* of the bearing member 27 for supporting the developing roller 32.

In this case, the storing medium 101 may only be required that the storing medium 101 is supported by the cleaning unit 60 as the first unit and is disposed outside the first bearing portion 73*a* and inside the outer configuration of the developing unit 20. As a result, the storing medium 101 is provided within the range created by the difference in longitudinal length between the cleaning unit 60 and the developing unit 20, and thus a similar effect can be obtained.

Modified Embodiment 2

In the above-described embodiment, the cartridge B as the process cartridge was described. That is, the cartridge which includes the first unit including the first bearing portion for supporting the image bearing member, the second unit including the second bearing portion for supporting the developer carrying member and the storing medium including the electrical contacts and which is insertable into the apparatus main assembly was described.

However, the present invention is not limited thereto, but may also be applicable to, as the process cartridge, a developing cartridge or an image bearing member cartridge (photosensitive member cartridge). That is, as the developing cartridge, a cartridge which includes the developing unit including the developing bearing portion for supporting the developer carrying member and the storing medium including the electrical contacts and which is insertable into the main assembly of the image forming apparatus may also be employed.

In this case, with respect to the rotational axis direction of the developer carrying member, the developing bearing portion is provided inside the image bearing member bearing portion. Further, at least a part of the storing medium is supported by the developing unit and is provided at a position outside the developing bearing portion and inside the outer configuration of the image bearing member unit including an image bearing member bearing portion. The electrical contacts are directed toward the downstream side with respect to the inserting direction of the cartridge into the apparatus main assembly.

Further, as the image bearing member cartridge (photosensitive member cartridge), a cartridge which includes the image bearing member unit including the image bearing member bearing portion for supporting the image bearing member and the storing medium including the electrical contacts and which is insertable into the apparatus main assembly of the image forming apparatus may also be employed.

In this case, with respect to the rotational axis direction of the image bearing member, the image bearing member bearing portion is provided insert the developing bearing portion. Further, at least a part of the storing medium is supported by the image bearing member unit and is provided at a position outside the image bearing member bearing portion and inside the outer configuration of the developer carrying member unit including the developing bearing portion. The electrical contacts are directed toward the downstream side with respect to the inserting direction of the cartridge into the apparatus main assembly.

According to the present invention, in order to establish stable electrical connection between the storing medium and the image forming apparatus main assembly, the positioning between the storing medium and the image forming apparatus main assembly relative to each other can be made without providing a particular space.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-234154 filed on Nov. 19, 2014, which is hereby incorporated by reference herein in its entirety.

What is claimed is:

1. A cartridge insertable into a main assembly of an image forming apparatus, comprising:

a first unit including a first bearing portion for rotatably supporting an image bearing member;

a second unit including a second bearing portion for rotatably supporting a developer carrying member; and a storing medium including an electrical contact, wherein said second bearing portion is provided inside said first bearing portion with respect to a rotational axis direction of said image bearing member, wherein at least a part of said storing medium is supported by said second unit and is provided at a position outside said second bearing portion and inside an outermost end of said first unit with respect to the rotational axis direction, and wherein said electrical contact faces toward a direction crossing the rotational axis direction.

2. A cartridge according to claim 1, wherein said storing medium is provided at a position of an end portion of said unit supporting said storing medium with respect to the rotational axis direction.

3. A cartridge according to claim 1, wherein said at least the part of said storing medium is provided between said bearing portion of one of said first and second units and said bearing portion of the other one of said first and second units with respect to the rotational axis direction.

4. A cartridge according to claim 1, wherein said storing medium includes the electrical contact at a plurality of positions with respect to the rotational axis direction.

5. A cartridge according to claim 1, further comprising an inserting opening for said storing medium with respect to the rotational axis direction.

6. A cartridge according to claim 1, wherein said electrical contact is faced toward a downstream with respect to an inserting direction of said cartridge into the main assembly.

7. A cartridge according to claim 6, wherein the inserting direction is a direction crossing the rotational axis direction.

8. A cartridge according to claim 1, wherein the first unit and the second unit are rotatably connected with each other, wherein the first unit comprises a portion-to-be-supported, and wherein the portion-to-be-supported is supported by the main assembly.

9. A cartridge according to claim 1, wherein the main assembly comprises a main assembly contact including a contact portion for connecting with said electrical contact, and the second unit comprises a positioning portion for limiting a position of the main assembly contact by engaging with the main assembly contact.

10. A cartridge insertable into a main assembly of an image forming apparatus, comprising:

a first unit including a first bearing portion for supporting an image bearing member;

a second unit including a second bearing portion for supporting a developer carrying member; and a storing medium including an electrical contact, wherein said first bearing portion is provided inside said second bearing portion with respect to a rotational axis direction of said image bearing member, wherein at least a part of said storing medium is supported by said first unit and is provided at a position outside said first bearing portion and inside an outermost end of said second unit with respect to the rotational axis direction, and wherein said electrical contact faces toward a direction crossing the rotational axis direction.

11. A cartridge insertable into a main assembly of an image forming apparatus, comprising:

a developing unit including a developing bearing portion for rotatably supporting a developer carrying member; and a storing medium including an electrical contact, wherein said developing bearing portion is provided inside an image bearing member bearing portion with respect to a rotational axis direction of said developer carrying member, wherein at least a part of said storing medium is supported by said developing unit and is provided at a position outside said developing bearing portion and inside an outermost end of an image bearing member unit including the image bearing member bearing portion with respect to the rotational axis direction, and wherein said electrical contact faces toward a direction crossing the rotational axis direction.

12. A cartridge insertable into a main assembly of an image forming apparatus, comprising:

an image bearing member unit including an image bearing member bearing portion for supporting an image bearing member; and a storing medium including an electrical contact, wherein said image bearing member bearing portion is provided inside a developing bearing portion with respect to a rotational axis direction of said image bearing member, wherein at least a part of said storing medium is supported by said image bearing member unit and is provided at a position outside said image bearing member bearing portion and inside an outermost end of a developer carrying member unit including the developing bearing portion with respect to the rotational axis direction, and wherein said electrical contact faces toward a direction crossing the rotational axis direction.

13. An image forming apparatus comprising:

a cartridge insertable into a main assembly of an image forming apparatus, said cartridge comprising:

a first unit including a first bearing portion for rotatably supporting an image bearing member, a second unit including a second bearing portion for rotatably supporting a developer carrying member, and a storing medium including an electrical contact, wherein said second bearing portion is provided inside said first bearing portion with respect to a rotational axis direction of said image bearing member, wherein at least a part of said storing medium is supported by said second unit and is provided at a position outside said second bearing portion and inside an outermost end of said first unit with respect to the rotational axis direction, and wherein said electrical contact faces toward a direction crossing the rotational axis direction; and a tray for mounting said cartridge, wherein said tray is movable between an inner position of the main assembly and an outer position of the main assembly.

14. An image forming apparatus according to claim 13, wherein an electrical contact of the main assembly opposing the electrical contact of the storing medium has a spring property.

15. An image forming apparatus, comprising:

a cartridge insertable into a main assembly of an image forming apparatus, including a first unit including a first bearing portion for supporting an image bearing member, a second unit including a second bearing portion for supporting a developer carrying member, and a storing medium including an electrical contact; and a tray for detachably mounting said cartridge, wherein said tray is movable between an inner position of the main assembly and an outer position of the main assembly, wherein the electrical contact faces toward a downstream with respect to an inserting direction of said cartridge placed on said tray into the main assembly, and wherein with respect to the inserting direction, said storing medium is provided upstream of said image bearing member.

16. An image forming apparatus according to claim 15, wherein the second bearing portion is provided inside the first bearing portion with respect to a rotational axis direction of the image bearing member, and wherein the storing medium is supported by the second unit and at least a part thereof is provided at a position outside the second bearing portion and inside an outermost end of the first unit with respect to the rotational axis direction.

17. An image forming apparatus according to claim 15, wherein the first bearing portion is provided inside the second bearing portion with respect to a rotational axis direction of the image bearing member, and wherein the storing medium is supported by the first unit and at least a part thereof is provided at a position outside the first bearing portion and inside an outermost end of the second unit with respect to the rotational axis direction.

18. An image forming apparatus according to claim 15, wherein a mounting direction of said cartridge into the tray crosses a movement direction of the tray between the inner position of the main assembly and the outer position of the main assembly.

19. An image forming apparatus according to claim 15, wherein a moving direction of the tray between the inner position of the main assembly and the outer position of the main assembly includes a horizontal direction.

20. An image forming apparatus according to claim 15, wherein the main assembly comprises a main assembly contact including a contact portion for connecting with said electrical contact, and the cartridge comprises a positioning portion for limiting a position of the main assembly contact by engaging with the main assembly contact.

21. A cartridge insertable into a main assembly of an image forming apparatus, comprising:

a first unit including a first bearing portion for supporting an image bearing member;

a second unit including a second bearing portion for supporting a developer carrying member; and a storing medium including an electrical contact, wherein said second bearing portion is provided inside said first bearing portion with respect to a rotational axis direction of said image bearing member, wherein at least a part of said storing medium is supported by said second unit and is provided at a position outside said second bearing portion and inside an outermost end of said first unit with respect to the rotational axis direction, wherein said electrical contact faces toward a direction crossing the rotational axis direction, and wherein with respect to an inserting direction of said cartridge into the main assembly, said storing medium is provided below and upstream of said image bearing member.

22. A cartridge according to claim 21, wherein said at least the part of said storing medium is provided between said bearing portion of one of said first and second units and said bearing portion of the other one of said first and second units with respect to the rotational axis direction.

23. A cartridge according to claim 21, wherein said storing medium includes the electrical contact at a plurality of positions with respect to the rotational axis direction.

24. A cartridge according to claim 21, further comprising an inserting opening for said storing medium with respect to the rotational axis direction.

25. A cartridge according to claim 21, wherein said electrical contact is faced toward a downstream with respect to an inserting direction of said cartridge into the main assembly.

26. A cartridge according to claim 21, wherein the inserting direction is a direction crossing the rotational axis direction.

27. A cartridge according to claim 21, wherein the first unit and the second unit are rotatably connected with each other, wherein the first unit comprises a portion-to-be-supported, and wherein the portion-to-be-supported is supported by the main assembly.

28. A cartridge according to claim 21, wherein the main assembly comprises a main assembly contact including a contact portion for connecting with said electrical contact, and the second unit comprises a positioning portion for limiting a position of the main assembly contact by engaging with the main assembly contact.

29. A cartridge insertable into a main assembly of an image forming apparatus having a main assembly contact including a contact portion, comprising:

a first unit including a first bearing portion for rotatably supporting an image bearing member;

a second unit and including a second bearing portion for rotatably supporting a developer carrying member and a side member;

a storing medium including an electrical contact for connecting the contact portion, wherein said second bearing portion is provided inside said first bearing portion with respect to a rotational axis direction of said image bearing member, wherein said storing medium is supported by the side member and is provided at a position outside said second bearing portion with respect to the rotational axis direction, wherein said electrical contact faces toward a downstream with respect to an inserting direction of said cartridge into the main assembly, wherein with respect to the inserting direction, said storing medium is provided upstream of said image bearing member, and wherein the side member includes a positioning portion for limiting a position of the main assembly contact by engaging with the main assembly contact.

30. A cartridge according to claim 29, wherein with respect to the inserting direction, said storing medium is provided below of said image bearing member.

31. A cartridge according to claim 29, wherein the inserting direction is a direction crossing the rotational axis direction.

32. A cartridge according to claim 29, wherein said at least the part of said storing medium is provided between said bearing portion of one of said first and second units and said bearing portion of the other one of said first and second units with respect to the rotational axis direction.

33. A cartridge according to claim 29, wherein said storing medium includes the electrical contact at a plurality of positions with respect to the rotational axis direction.

34. A cartridge according to claim 29, further comprising an inserting opening for said storing medium with respect to the rotational axis direction.

35. A cartridge according to claim 29, wherein the inserting direction is a direction crossing the rotational axis direction.

36. A cartridge according to claim 29, wherein the first unit and the second unit are rotatably connected with each other, wherein the first unit comprises a portion-to-be-supported, and wherein the portion-to-be-supported is supported by the main assembly.

* * * * *